US008892348B2

(12) United States Patent
Chamlou

(10) Patent No.: US 8,892,348 B2
(45) Date of Patent: Nov. 18, 2014

(54) METHOD AND SYSTEM FOR AIRCRAFT CONFLICT DETECTION AND RESOLUTION

(75) Inventor: Roxaneh Chamlou, McLean, VA (US)

(73) Assignee: The Mitre Corporation, McLean, VA (US)

( * ) Notice: Subject to any disclaimer, the term of this patent is extended or adjusted under 35 U.S.C. 154(b) by 807 days.

(21) Appl. No.: 12/949,070

(22) Filed: Nov. 18, 2010

(65) Prior Publication Data

US 2011/0118981 A1 May 19, 2011

Related U.S. Application Data

(60) Provisional application No. 61/272,911, filed on Nov. 18, 2009.

(51) Int. Cl.
*G08G 5/04* (2006.01)

(52) U.S. Cl.
CPC ..... *G08G 5/045* (2013.01)
USPC ..... 701/301; 701/302

(58) Field of Classification Search
USPC ..... 701/301, 302
See application file for complete search history.

(56) References Cited

U.S. PATENT DOCUMENTS

| | | | | |
|---|---|---|---|---|
| 6,262,679 | B1 * | 7/2001 | Tran | 342/29 |
| 6,314,366 | B1 * | 11/2001 | Farmakis et al. | 701/482 |
| 6,785,610 | B2 * | 8/2004 | Baker et al. | 701/301 |
| 2004/0059504 | A1 * | 3/2004 | Gray | 701/301 |
| 2007/0171042 | A1 * | 7/2007 | Metes et al. | 340/521 |
| 2008/0021647 | A1 * | 1/2008 | Daveze et al. | 701/301 |
| 2008/0027647 | A1 * | 1/2008 | Ansell et al. | 701/301 |
| 2009/0088972 | A1 * | 4/2009 | Bushnell | 701/210 |

FOREIGN PATENT DOCUMENTS

WO WO 2007095671 A1 * 8/2007 ..... G08G 3/02

OTHER PUBLICATIONS

A Geometric Approach to Strategic Conflict Detection and Resolution, by Cesar Munoz and Alfons Geser—Nasa Langley Research Center, Hampton Virginia. Reference downloaded from IEEE on Nov. 17, 2008.*

James K. Kuchar and Lee C. Yang, "Survey of Conflict Detection and Resolution Modeling Methods," in Proc. AIAA Guidance, Navigation, and Control Conf., New Orleans, LA, 1997, AIAA-97-3732, pp. 1388-1397.

Joseph M. Cychosz and Warren N. Waggenspack, Jr., "Intersecting a Ray with a Cylinder," Graphics Gems IV, Copyright 1994 by Academic Press, Inc., pp. 356-365.

(Continued)

*Primary Examiner* — John R Olszewski
*Assistant Examiner* — Jess Whittington
(74) *Attorney, Agent, or Firm* — Sterne, Kessler, Goldstein & Fox P.L.L.C.

(57) ABSTRACT

Methods, systems, and computer program products for aircraft conflict detection and resolution are proposed. Embodiments of the present invention detect potential conflicts without a predetermined look-ahead time threshold and determine the time for issuing resolution alerts dynamically based on the relative movements of the aircraft. A method embodiment for detecting a potential airborne conflict between an ownship and at least one intruder includes, determining a relative motion trajectory of the ownship and the intruder, generating a plurality of resolution advisories based upon the determined relative motion trajectory and corresponding to respective motion dimensions of the ownship, determining an alert time for each of the plurality of RAs responsive to the corresponding motion dimension and the determined relative motion trajectory, and transmitting at least one of the plurality of RAs to at least one of the ownship or an aircraft control entity.

20 Claims, 16 Drawing Sheets

(56) References Cited

OTHER PUBLICATIONS

Karl D. Bilimoria, "A Geometric Optimization Approach to Aircraft Conflict Resolution," Guidance, Navigation, and Control Conference, Aug. 2000, pp. 1-11, vol. AIAA, Denver, CO.

Alfons Geser, César Muñoz, "A Geometric Approach to Strategic Conflict Detection and Resolution," Digital Avionics Research Conference, Oct. 2002, pp. 6.B.1-1-6.B.1-11.

Ralph Bach, Chris Farrell and Heinz Erzberger, "An Algorithm for Level-Aircraft Conflict Resolution," NASA Ames Research Center, Moffen Field, CA, May 2007, pp. 1-12.

Gilles Dowek and César Muñoz, "Conflict Detection and Resolution for 1, 2, . . . ,N Aircraft," 7$^{th}$ AIAA Aviation Technology, Integration and Operations Conference, Sep. 18-20, 2007, Belfast, Northern Ireland, pp. 1-13.

* cited by examiner

METHOD AND SYSTEM FOR AIRCRAFT CONFLICT DETECTION AND RESOLUTION

CROSS REFERENCE TO RELATED APPLICATIONS

This application claims the benefit of U.S. provisional application No. 61/272,911, filed on Nov. 18, 2009, which is hereby incorporated by reference in its entirety.

BACKGROUND OF THE INVENTION

1. Field of the Invention

The present invention relates generally to aircraft conflict detection and resolution.

2. Background

Aircraft traffic has been steadily increasing over the years. In particular, the air space in and around major population areas or other popular locations can be significantly congested. Added to this general increase in air traffic, are aspects such as the variety of aircraft with different sets of capabilities and preferences, restricted airspaces, and like factors that further aggravate the issues related to airspace congestion.

Conflict detection approaches for aircraft are designed to predict potential collisions between two or more aircraft. Conventional aircraft conflict detection approaches typically predict the path of a first aircraft for a predetermined look-ahead time interval, and determine whether a second aircraft is likely to come within a predetermined distance of the first aircraft during that time interval.

Conflict resolution methods address the issue of how a predicted aircraft conflict is avoided. Conventional aircraft conflict resolution typically involves one or both aircraft taking action to avoid the detected potential conflict by, for example, changing direction or changing speed.

Algorithms for Conflict Detection and Resolution (CD&R) systems have been widely studied. The methods used for CD&R can be broadly grouped into three categories: Probabilistic, Force Field, and Geometric. Probabilistic methods use uncertainties in the model to develop a set of possible future trajectories, each weighted by its probability of occurring. Force field methods model each aircraft as a charged particle and use modified electrostatic equations to determine resolution maneuvers. The "repulsive forces" between aircraft are used to define the maneuver each performs to avoid a collision. Even though this method provides a global (i.e., not restricted to pair-wise) solution to CD&R, several characteristics of this method make it difficult to incorporate in practical systems. Geometric CD&R methods use linear projections to predict aircraft trajectories as opposed to probabilistic or performance-based trajectories. They utilize positions and velocity vectors of aircraft involved in the encounter for collision detection by comparing velocity vectors of vehicles, and collision resolution/avoidance by providing encounter geometry to the resolution guidance algorithm.

Bilimoria, in "A Geometric Optimization Approach to Aircraft Conflict Resolution," AIAA Guidance, Navigation, and Control Conference and Exhibit, Denver, Colo., 2000, presents a geometric optimization approach where the resolutions are optimal in the sense that they minimize the velocity vector changes required for conflict resolution. In Bilimoria's proposed approach, the resolutions are optimal for pair-wise encounter maneuvers, but not for multiple threat conflict encounter maneuvers. Dowek and Muñoz, in "Tactical Conflict Detection and Resolution in 3-D Airspace," 4th USA/Europe Air Traffic Management R&D Seminar (ATM-2001), Santa Fe, N. Mex., 2001, presents KB3D, which is a tactical CD&R algorithm in a 3-D space for two aircraft that produces a set of solutions. KB3D is a state-based geometric CD&R algorithm. In CD&R-related literature, tactical algorithms use only state information to project aircraft trajectories and are intended to be used with short look-ahead times (a few minutes, typically 5-10) during which aircraft are likely to follow straight flight paths. KB3D computes independent maneuvers for the ownship (i.e., aircraft whose maneuvers are to be controlled by the CD&R system) each of which solves the conflict assuming that the ownship maneuvers.

As the airspace becomes more congested, the variety and capabilities of aircraft increase, and safer and/or better optimized air travel to reduce travel times and flight paths are sought, the problems of CD&R increase in relevance. As the demands of more crowded airspace intensify, it is desired that accurate potential conflict information is conveyed to the aircraft, while simultaneously reducing false alarms (e.g. unnecessary resolution advisories sent to aircraft). More accurate prediction of conflicts can be used advantageously in environments in which the aircraft that can potentially collide are both controllable, as well as in environments where only one of the aircraft (e.g. ownship) can be controlled in a manner to avoid the predicted collision.

What are needed therefore, are improved CD&R methods and systems that are more responsive and that can reduce false alarms.

SUMMARY OF THE INVENTION

Methods and systems for aircraft conflict detection and resolution are proposed. Embodiments of the present invention detect potential conflicts without a predetermined look-ahead time threshold and determine the time for issuing resolution alerts dynamically based on the relative movements of the aircraft and ownship maneuver capabilities.

A method embodiment for detecting a potential airborne conflict between an ownship and at least one intruder includes, determining a relative motion trajectory of the ownship and the intruder, generating a plurality of resolution advisories based upon the determined relative motion trajectory and corresponding to respective motion dimensions of the ownship, determining an alert time for each of the plurality of resolution advisories responsive to the corresponding motion dimension and the determined relative motion trajectory, and transmitting at least one of the plurality of resolution advisories to at least one of the ownship or an aircraft control entity.

A system for embodiment for detecting a potential airborne conflict between an ownship and at least one intruder, includes, at least one processor, a relative velocity determiner configured to determine a relative velocity of the ownship and the intruder, a resolution advisory generator configured to generate a plurality of resolution advisories based upon the determined relative velocity and corresponding to respective motion dimensions of the ownship, and an alert generator configured to determine an alert time for each of the plurality of resolution advisories responsive to the corresponding motion dimension and the determined relative velocity and ownship maneuver capabilities.

According to another embodiment, a computer readable media storing instructions where the instructions when executed are adapted to detect a potential airborne conflict between an ownship and at least one intruder is described. The method includes, determining a relative velocity of the ownship and the intruder, generating a plurality of resolution advisories based upon the determined relative velocity and corresponding to respective motion dimensions of the ownship, determining an alert time for each of the plurality of resolution advisories responsive to the corresponding motion dimension and the determined relative velocity, ownship maneuver capabilities, and transmitting at least one of the plurality of resolution advisories to at least one of the ownship or an aircraft control entity.

Further features and advantages of the present invention, as well as the structure and operation of various embodiments thereof, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

FIG. 8 geometrically illustrates a scenario for determining the alert time for a resolution advisory that includes a maneuver in the horizontal dimension decreasing speed, according to an embodiment of the present invention.

Figure 9:
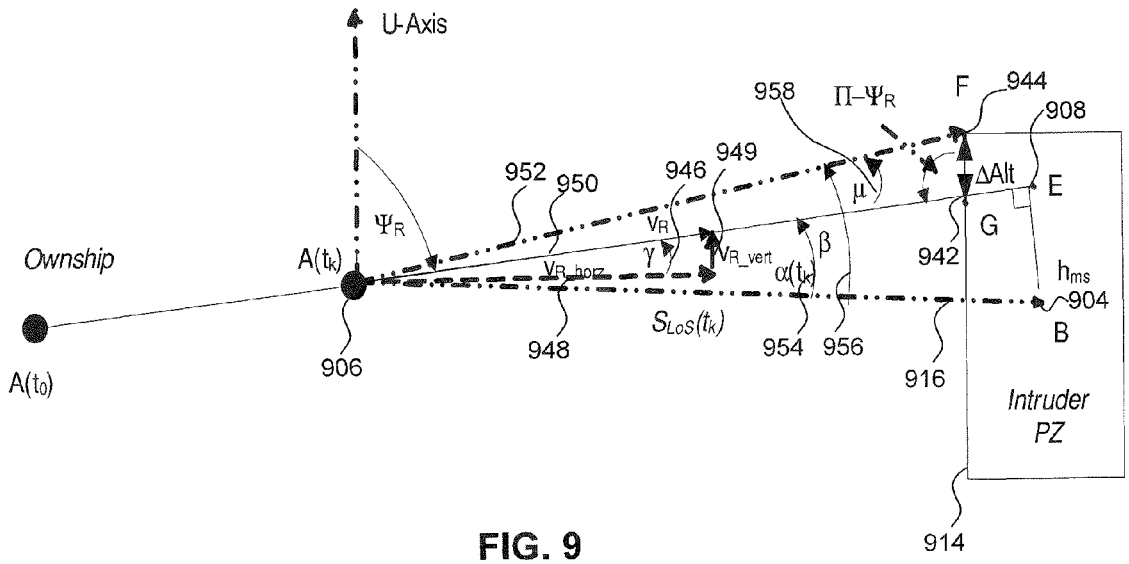

FIG. 9 geometrically illustrates a scenario to determine the alert time for a vertical climb maneuver, according to an embodiment of the present invention.

Figure 10:
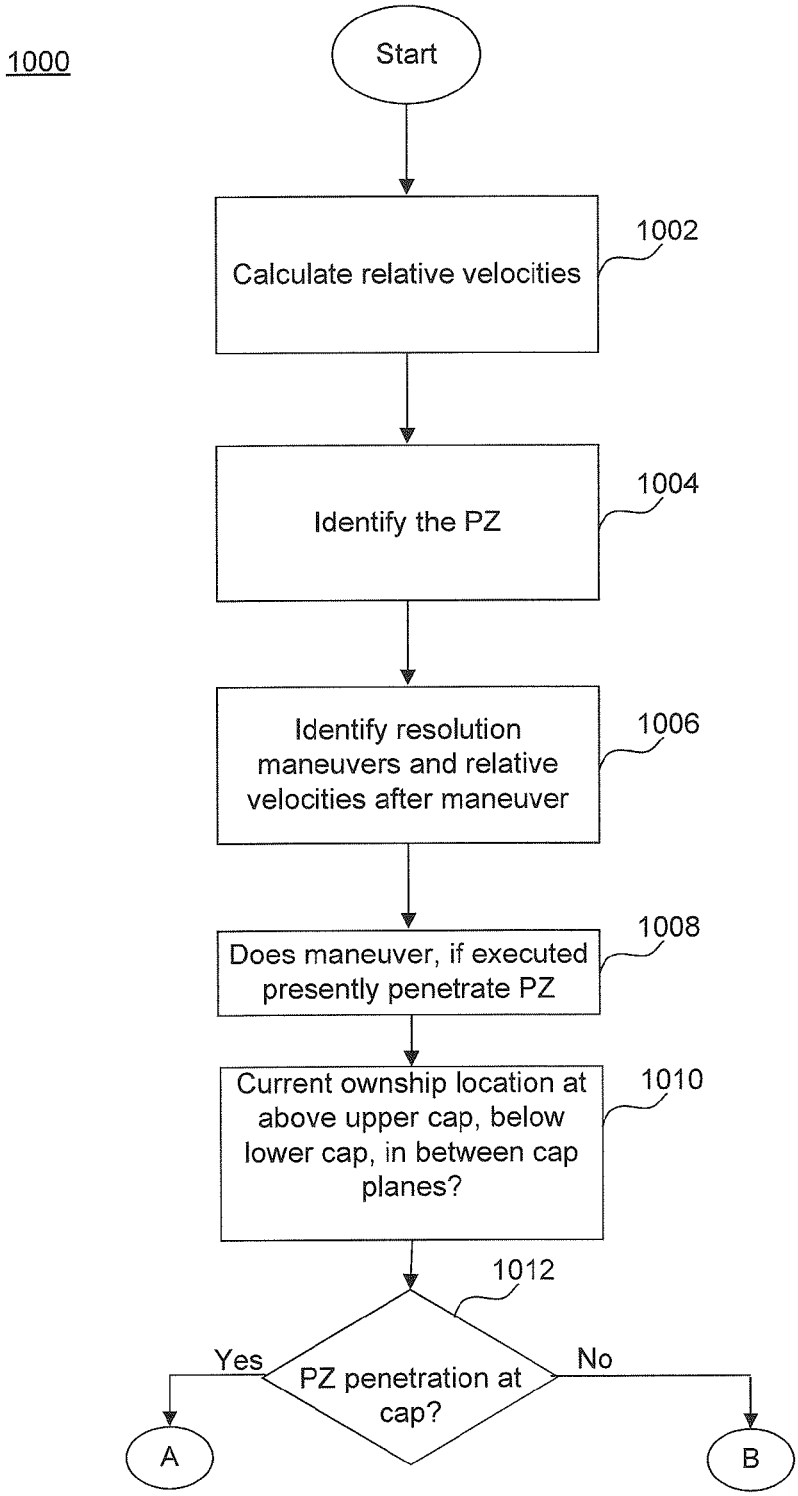
Figure 11:
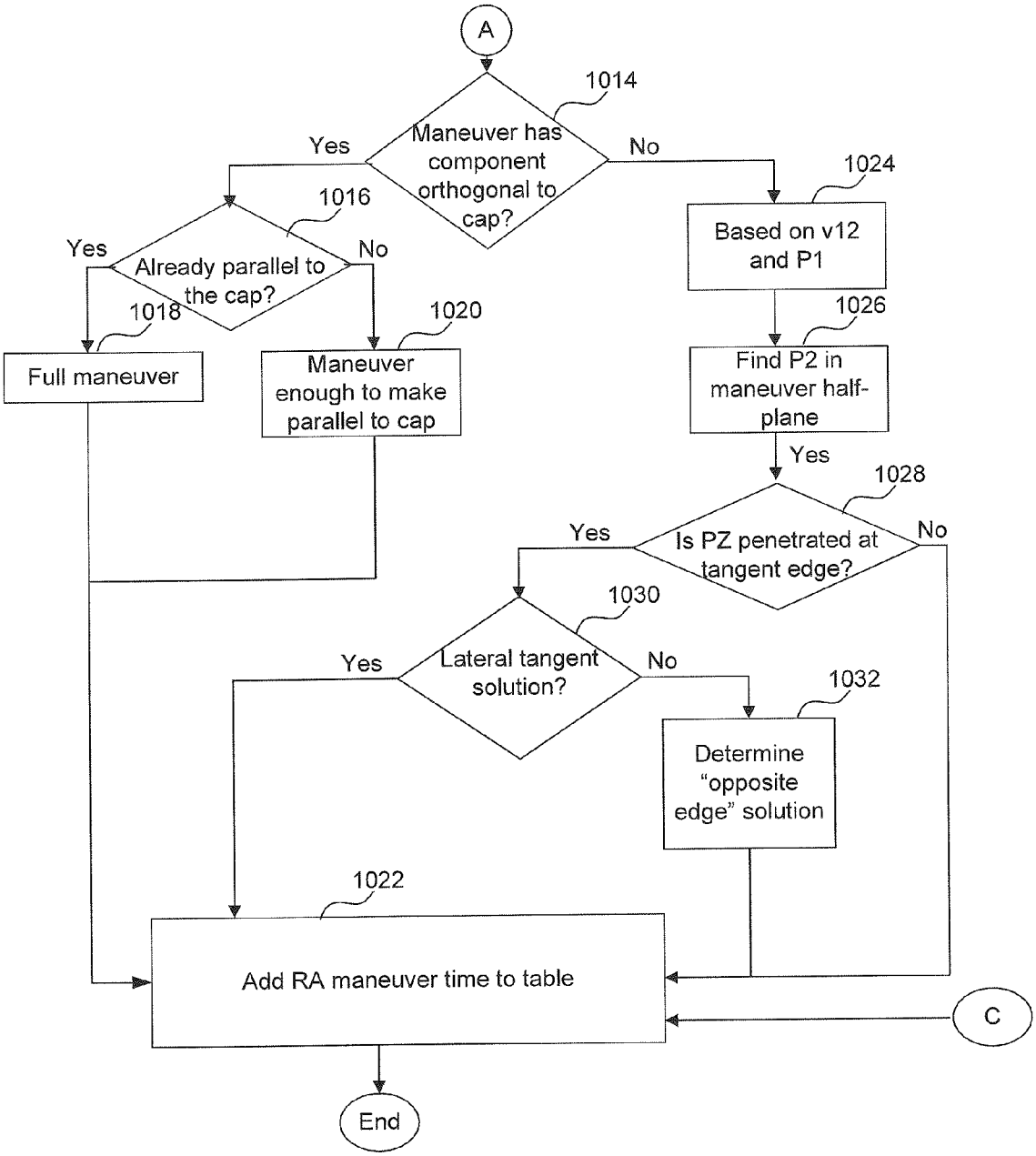
Figure 12:
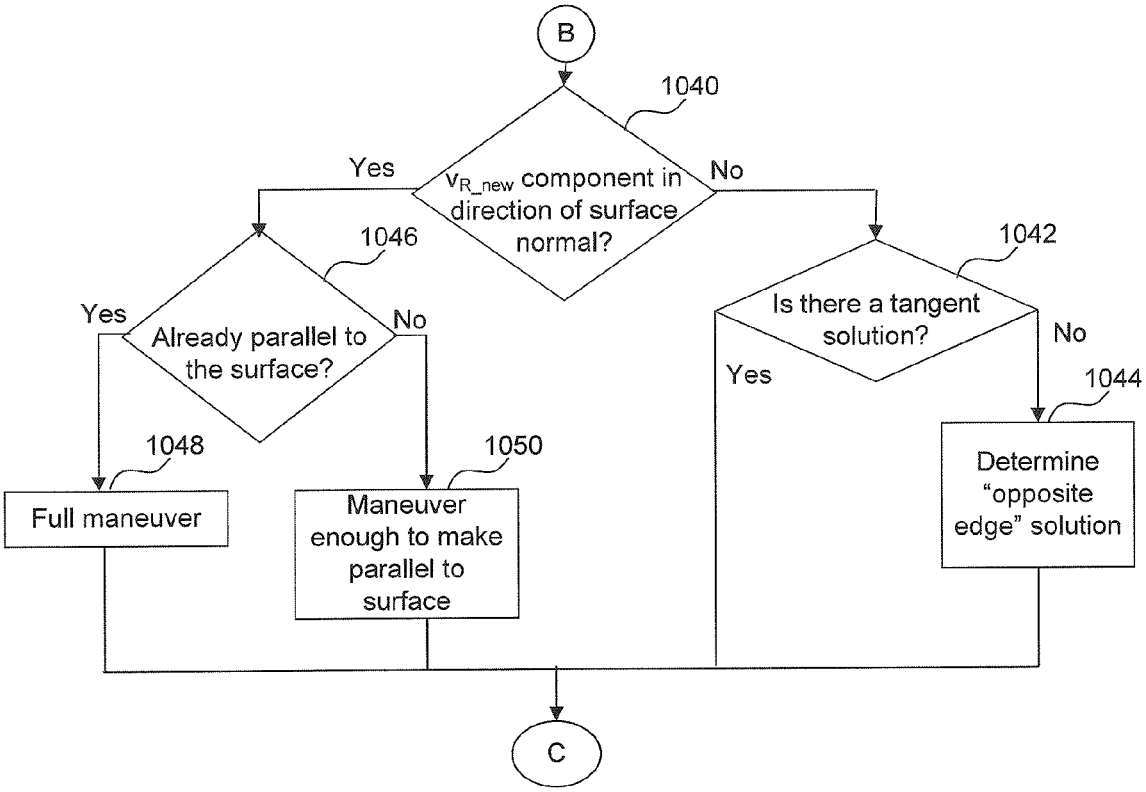

FIGS. 10-12 illustrate methods of determining conflict resolution alerts for a CD&R system, according to an embodiment of the present invention.

Figure 13:
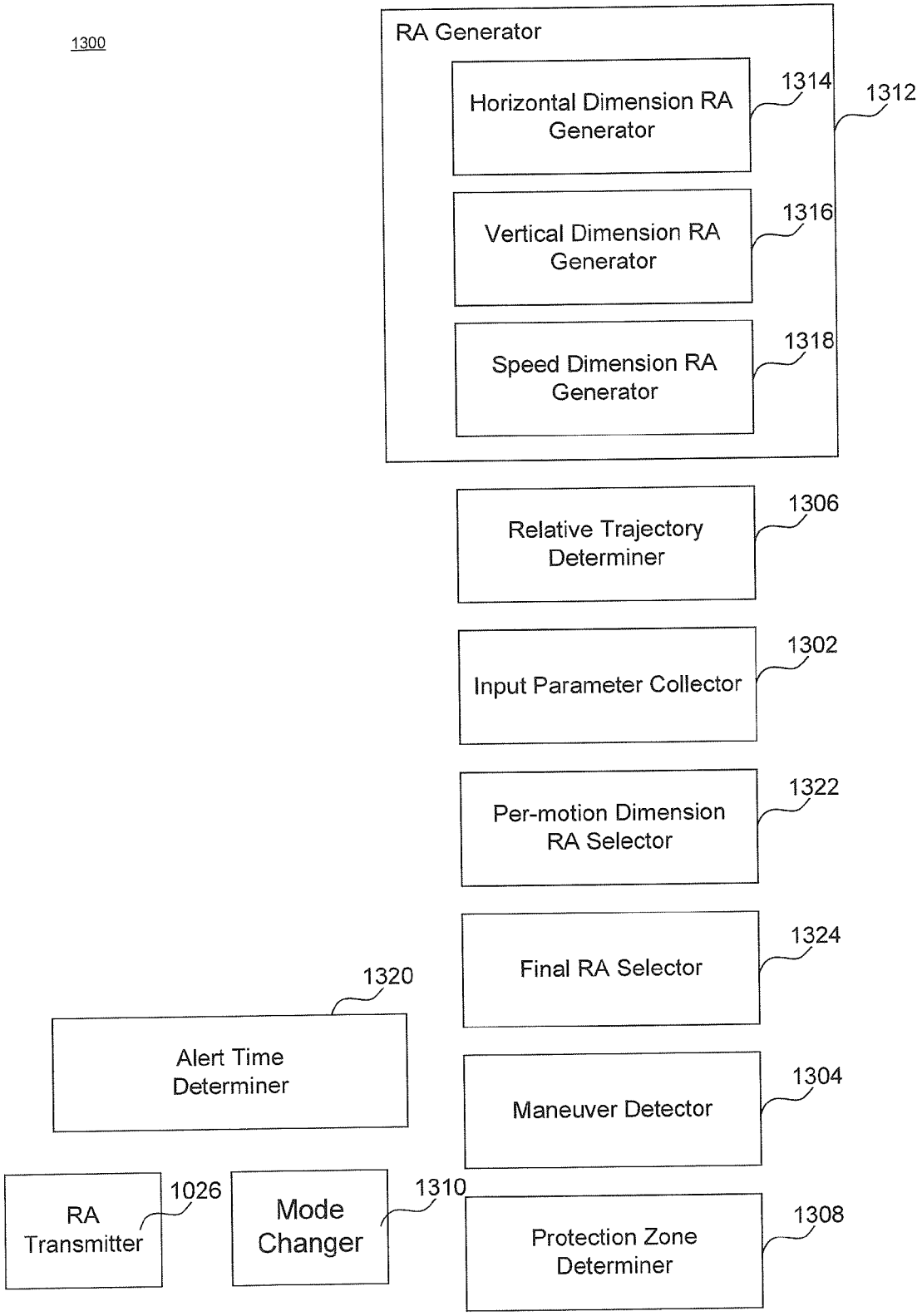

FIG. 13 is a collision detection and resolution system, according to an embodiment of the present invention.

Figure 14:
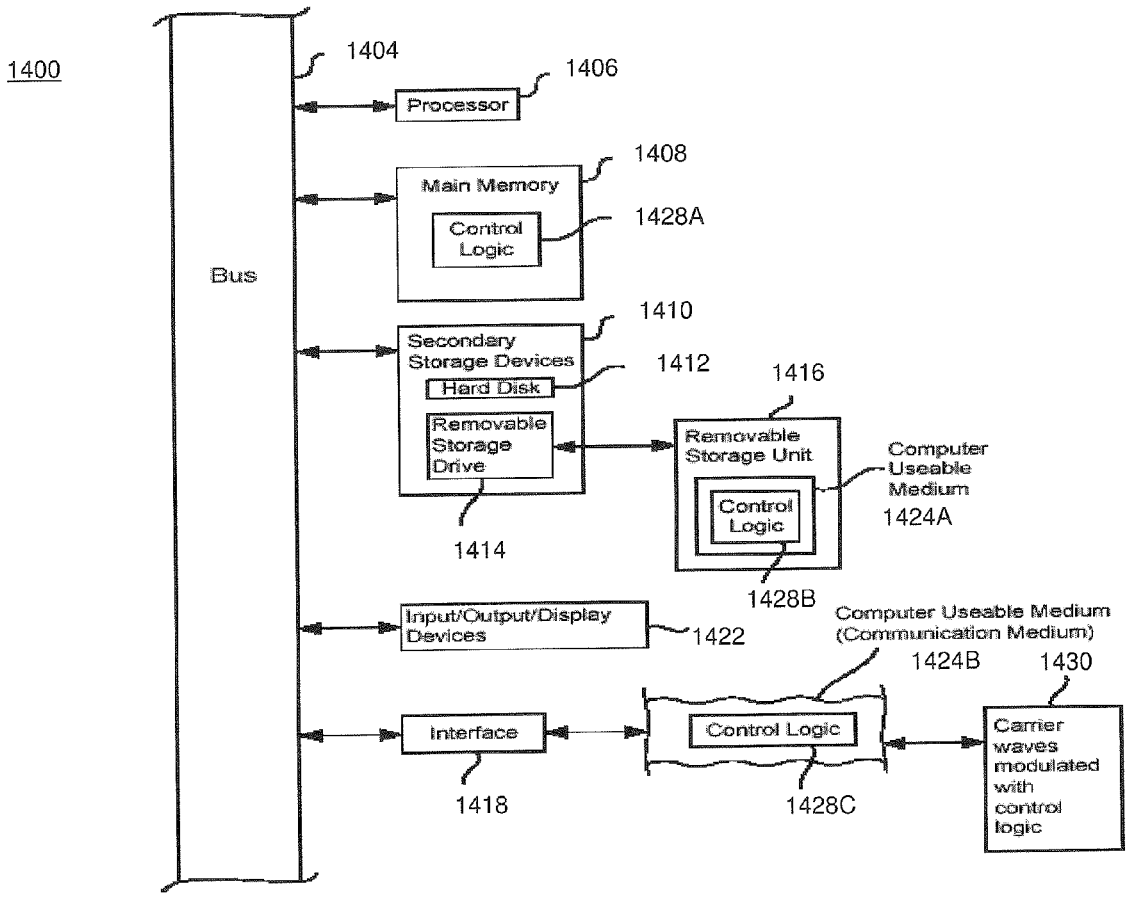

FIG. 14 is a computer system for collision detection and resolution, according to an embodiment of the present invention.

The features and advantages of the present invention will become more apparent from the detailed description set forth below when taken in conjunction with the drawings. In the drawings, like reference numbers generally indicate identical, functionally similar, and/or structurally similar elements. Generally, the drawing in which an element first appears is indicated by the leftmost digit(s) in the corresponding reference number.

DETAILED DESCRIPTION OF THE INVENTION

While the present invention is described herein with reference to illustrative embodiments for particular applications, it should be understood that the invention is not limited thereto. Those skilled in the art with access to the teachings herein will recognize additional modifications, applications, and embodiments within the scope thereof and additional fields in which the invention would be of significant utility.

Embodiments of the present invention relate to aircraft CD&R. Embodiments of the present invention determine potential conflicts for an aircraft and, based on a plurality of motion dimensions, dynamically determine when one or more corresponding resolution alerts are to be transmitted. The plurality of motion dimensions can include the vertical, horizontal, and temporal dimensions, and represent some or all of the dimensions in which the aircraft can take action to avoid the predicted conflict. Embodiments can evaluate resolution advisories in the plurality of motion dimensions, such as in the vertical, horizontal, and temporal dimensions, in order to select the one or more resolution advisories that are most suitable for the capabilities and preferences of the aircraft. By performing conflict detection and analysis based on a plurality of motion dimensions and then by dynamically determining the optimal maneuver to avoid the conflict, embodiments of the present invention provide an improved method of aircraft CD&R that is more suited to addressing the challenges of the current and future airspaces.

Embodiments in the present invention differ from conventional methods of CD&R due to many factors, including that the present invention does not require a fixed look-ahead time (i.e., RA alert threshold) to declare a conflict. In many conventional systems, for example, the RA alert thresholds are parameterized by a sensitivity level which is determined according to the altitude. Since the sensitivity level is a function of altitude, the RA alert thresholds vary with altitude. In such conventional systems, the RA alert thresholds are determined based on prior tuning over many types of encounters at each of the altitude levels.

Embodiments of the present invention provide model-based solutions that explicitly compute RA alert thresholds that ensure no violation of a specified protection zone (PZ) which is defined surrounding the intruder location. These RA alert thresholds take into account the actual 3-D geometry of the potential encounter, the closure rate of the aircraft, the PZ, and ownship maneuver capabilities. When available, additional inputs such as measurement uncertainties and intruder type can be used to alter the PZ. The choice of PZ will allow embodiments to address a range of applications (from separation assurance to collision avoidance) and to adapt to the evolving airspace and aircraft (e.g., new technologies and capabilities of aircraft). Embodiments can also have the capability of detecting intruder or ownship maneuvers. This information can be used to increase the PZ in order to trigger earlier RA alerts.

Example Method Embodiments

Figure 1A:
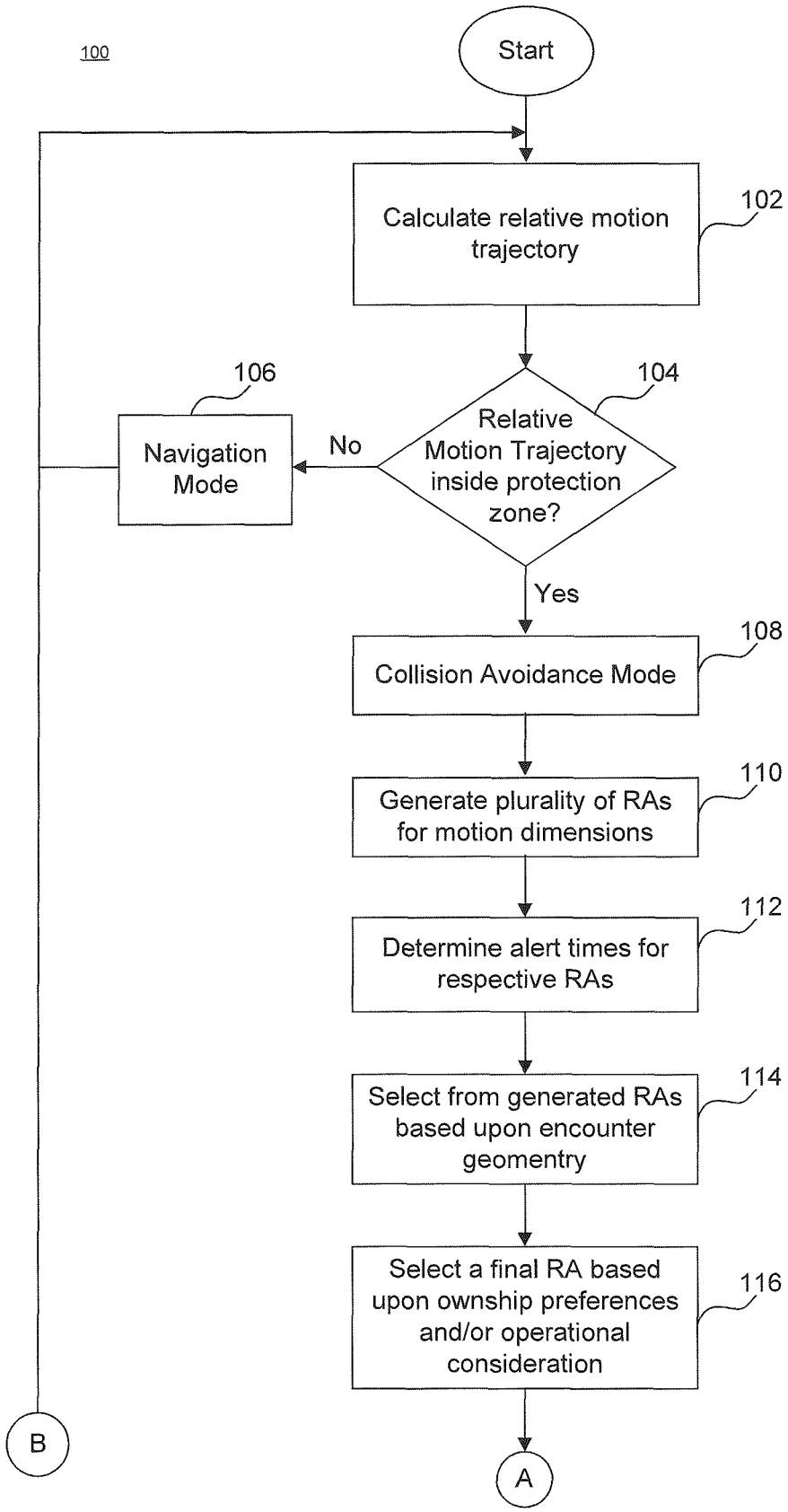
FIGS. 1A and 1B are flowcharts of a method for aircraft CD&R, according to an embodiment of the present invention.
Figure 1B:
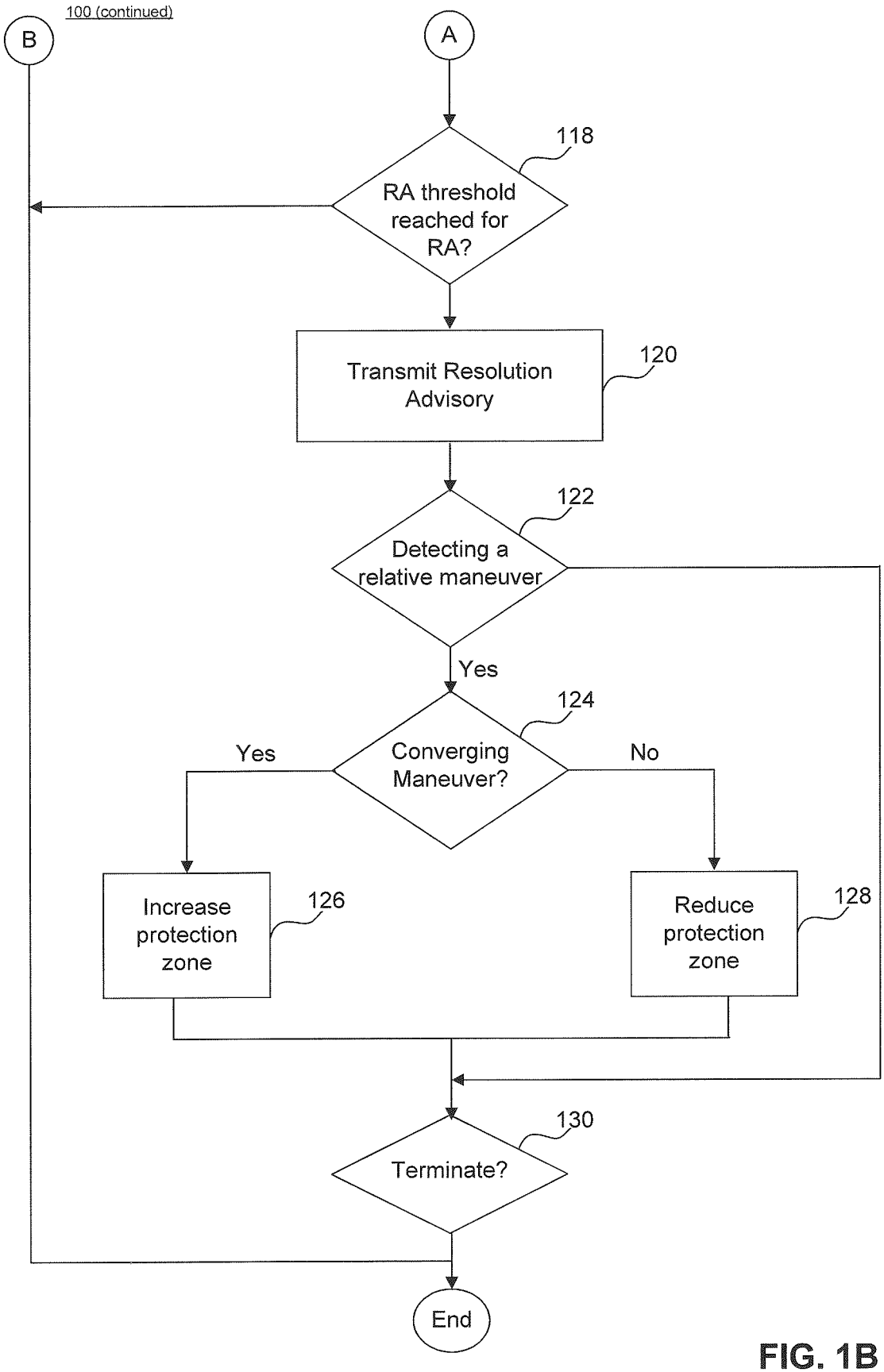

FIGS. 1A and 1B are flowcharts of a method 100 for aircraft CD&R, according to an embodiment of the present invention. Method 100 can be used to detect a potential conflict between a first aircraft travelling in the airspace on a path to a predetermined destination. Herein, the first aircraft is referred to as the "ownship" and is the aircraft that is controlled according to the CD&R methods of embodiments of the present invention. Aircraft that can intrude into the path of the ownship and cause potential conflicts are referred to as intruder aircraft or simply as "intruder." A conflict is a potential collision, or more specifically, the approaching of the ownship and an intruder within a predetermined and/or dynamically determined distance of each other.

In step 102, a relative motion trajectory is determined between the ownship and an intruder. According to an embodiment, a relative velocity vector between the ownship and the intruder is determined. The intruder can then be considered stationary and the ownship future trajectory can be represented as a ray in the direction of the relative vector under the assumption of constant velocities. The determination of the relative velocity vector is further described below in relation to FIG. 2.

In step 104 it is determined whether a potential conflict between the ownship and intruder can be predicted. According to an embodiment, a PZ is defined surrounding the intruder at its current position. The PZ can be a predetermined size and shape, and defines an area around the intruder into which, if the ownship comes in, a conflict would occur. As noted above, as used herein, a conflict is a potential collision. According to an embodiment, the PZ is defined as a vertical cylinder capped by flat surfaces at the two ends. The cylinder is centered on the current relative position of the intruder. A conflict can then be predicted if it is determined that the path of the ownship, according to the relative velocity vector, intersects the PZ. The determination, for example, of whether the path according to the relative velocity vector intersects the cylindrical PZ can be made using methods to solve for the points of intersection between a ray and a finite cylinder bounded by two planar end-caps. An exemplary method of efficiently solving for the points of intersection between a ray and a finite cylinder is described by Cychosz and Waggenspack in "Intersecting a Ray with a Cylinder," in Paul Heckbert (editor), Graphics Gems IV, Academic Press.

If, in step 104, it is determined that the ownship path does not intersect the PZ, then no conflict is predicted and the system either stays in, or transitions to, a navigation mode 106. According to an embodiment, both, in the navigation mode as well as in the conflict avoidance mode, the ownship or the entity, such as an air traffic control entity that is capable of controlling and/or causing the ownship to maneuver according to resolution advisories, executes method 100 at predetermined intervals. In the navigation mode, the ownship continues flying to its destination along a previously determined path. Subsequent to transitioning to, or continuing in, the navigation mode, processing proceeds to step 102 after a predetermined interval.

If, in step 104, it is determined that the ownship path does intersect the PZ, then the system either stays in, or transitions to, a conflict avoidance mode 108. In the conflict avoidance mode the ownship prepares for, and subsequently executes, one or more evasive maneuvers to avoid the potential conflict. Transitioning the ownship to navigation mode or to the conflict avoidance mode can involve the initiation of several activities and/or processes including configuration of various equipment. Subsequent to transitioning or continuing in conflict avoidance mode 108, processing of method 100 proceeds to step 110.

In step 110, the ownship generates a plurality of resolution advisories (RAs) based upon the conflict predicted in step 104. Resolution advisories are instructions, or commands, to the ownship and/or an entity controlling the ownship to effect a change in path or speed of the ownship in an attempt to avoid the predicted conflict. According to an embodiment, one or more RAs are generated internally by the CD&R system for each of a plurality of motion dimensions of the ownship. According to an embodiment, one or more RAs are created respectively for a horizontal dimension, a vertical dimension, and a speed dimension. Generation of RAs is further described below in relation to FIG. 3.

In step 112, the alert time for the respective resolution alerts are determined. According to an embodiment, for each generated resolution alert, an alert time is determined. The alert time is determined as substantially the latest time at which the ownship can initiate the respective maneuver based upon the recommended parameters in order to avoid the potential conflict. More specifically, the alert time is determined as the latest time at which the direction change and/or speed change can be initiated in the ownship such that the new path of the ownship avoids intersecting the PZ defined around the intruder. According to an embodiment, the potential conflict can be considered as avoided if the ray representing the new path (after initiating the maneuver corresponding to the respective resolution advisory) can be moved to the surface of the cylinder representing the PZ.

Figure 5:
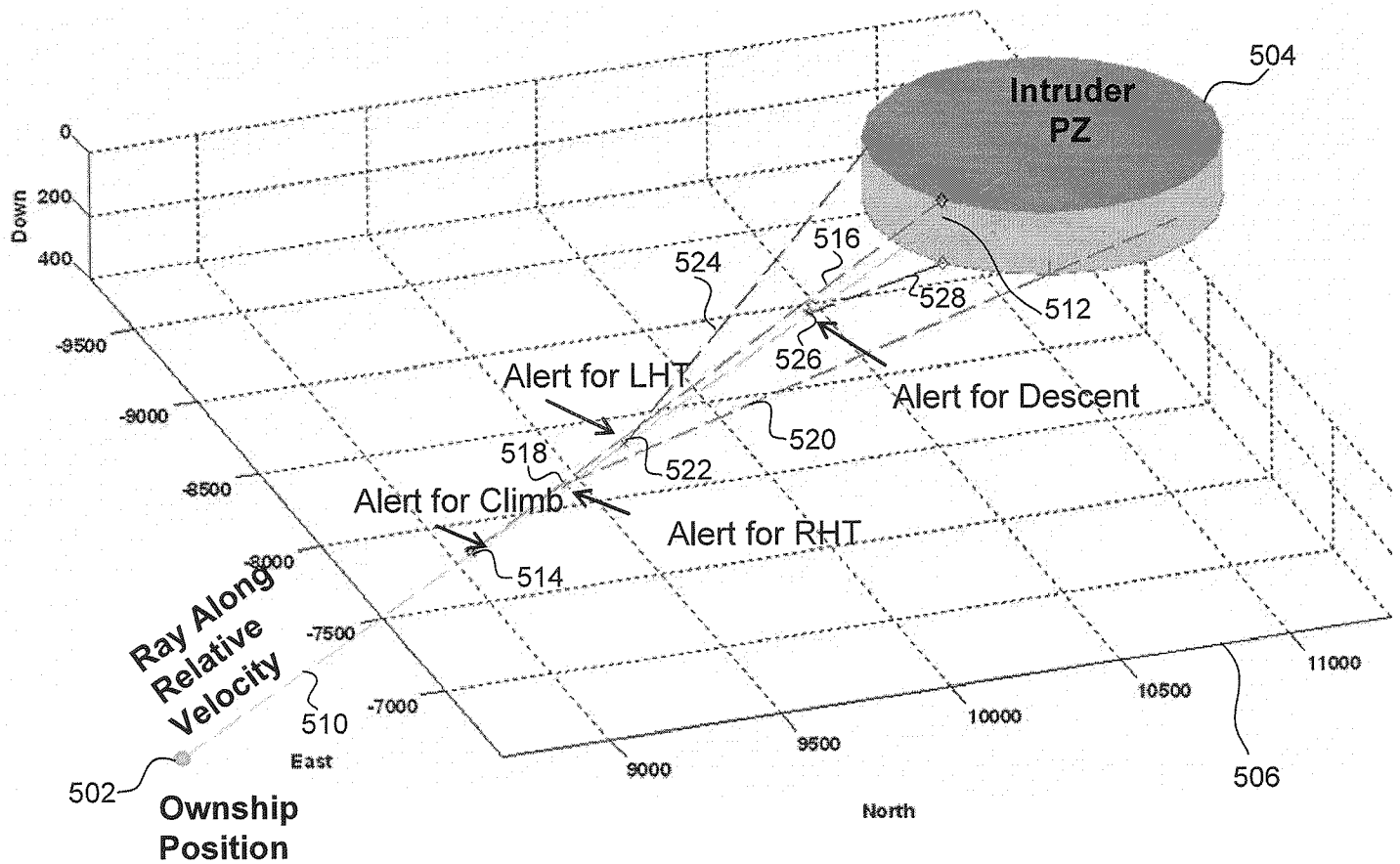
FIG. 5 is an illustration of an ownship aircraft, a protection zone associated with an intruder aircraft, a projected path of the ownship, and potential paths for conflict resolution, according to an embodiment of the present invention.

FIG. 5 graphically illustrates the various RAs generated for a plurality of motion dimensions, according to an embodiment. If the ownship, currently at location 502, continues in its current flight path 510, it will intrude into the PZ 504 at a point 512. According to an embodiment, various RAs and corresponding alert times have been determined. The 'climb' RA should be transmitted at the 514 point, so that the ownship can climb along path 516 to reach the top edge of the PZ cylinder. At the 518 point, an alert can be transmitted for a right hand turn to travel along the path 520 to reach the right hand side of the PZ. At the 522 point, an alert can be transmitted for a left hand turn to travel along the path 524 to reach the left hand side of the PZ. Also, at the 526 point, an alert can be transmitted for descending to travel along the path 528 to reach the lower edge of the PZ. 514, 518, 522, and 526 can correspond to the times at which the respective RAs are initiated.

In step 114, in a first down-selection from the plurality of generated RAs, one or more RAs are selected for each motion dimension. For example, for each motion dimension a predetermined number of RAs that yield the minimum alert time can be selected in the first down-selection. According to an embodiment, in the first down-selection, one RA is selected for each motion dimension. According to an embodiment, at the end of step 114, the potential RAs comprise one RA each for the horizontal dimension, vertical dimension, and time dimension. According to an embodiment, the first down selection can be based upon factors such as the encounter geometry and actual closure rate between ownship and intruder. For each motion dimension, the RA yielding the lowest alert time is selected, and any ties are resolved using criteria such as by specifying a particular direction (e.g., right turn in horizontal dimension, climb in vertical dimension, slow down in speed dimension) where the ownship and intruder approach within particular distances from each other. The alert time corresponding to each RA can, for example, be determined in a previous step.

In step 116, one or more final RAs are selected from the respective RAs selected for each of the motion dimensions. According to an embodiment, the second down-selection to select the one or more final RAs can be based upon ownship preferences and capabilities and/or operational considerations. Ownship preferences and capabilities can include ownship specific performance capabilities such as stronger performance capabilities (e.g., steeper climb rate capabilities) in vertical maneuvers over horizontal or speed maneuvers that would enable a later resolution alert time, and specific pilot preferences (e.g., pilot training for particular maneuvers), and the like. Operation considerations can include terrain geography (e.g., ocean, mountains, flat land), other terrain considerations such as a type (e.g., urban, lightly populated, proximity to friendly/unfriendly territory), proximity to aircraft other than the identified intruder, and the like. According to an embodiment, ownship preferences and capabilities and operational considerations are listed in a look up table with a score corresponding to the ownship preference of each type of maneuver. For example, for the preference element of pilot training, depending on the pilot's actual training, weighted scores may be assigned to each of the motion dimensions. According to an embodiment, a score based upon the total score comprising respective scores for capabilities and preference elements, terrain considerations, and other predetermined operations considerations can be calculated for each RA selected in the previous steps. The determination of the one or more final RAs can be based upon further selecting a predetermined number of the RAs based upon a score calculated as described above.

Other criteria for selecting the final one or more RAs can include right-of way rules that favor RAs that are consistent with the known or accepted aircraft right of way rules, favor RAs that can keep visual contact of the intruder, considerations to keep to the same operational plane as the intruder (e.g., correspond the ownship RA to the intruder's maneuver, if any), favor RAs that would not leave ownship vulnerable to hazardous level-off by the intruder, favor RAs that do not require an altitude or lateral crossing, and favor not reversing an existing active RA against a continuing threat intruder.

Subsequent to selecting the final one or more RAs, in step 118, it is determined whether the corresponding one or more RA thresholds have been reached. According to an embodiment, it is determined in step 118 whether the alert time corresponding to any of the final one or more RAs have been reached.

If no RA thresholds have been reached, according to an embodiment, no further processing is required for the selected RAs, and processing of method 100 can proceed to step 102.

If, however, at least one RA threshold has been reached, then, according to an embodiment, processing proceeds to step 120. In step 120, the one or more selected RAs are transmitted to the ownship and/or a control entity capable of effecting changes in the path of the ownship. According to an embodiment, the selected one or more RAs that, in step 118, were determined to have reached the RA threshold are transmitted to the ownship and/or a ground air traffic controller in order to initiate the recommended maneuver or maneuvers designed to avoid the predicted conflict with the intruder. The transmission of the one or more RAs can be performed using any known transmission methods for RAs. Transmission can include sending the RA as a message or other signal to a remotely or locally located automated control equipment and/or human operator.

In step 122, the current positions of the ownship and intruder are detected in order to ascertain whether a relative maneuver of either the ownship and/or intruder has occurred. A relative maneuver can be detected by monitoring, for example, any change in the closest point of approach (CPA) between ownship and intruder. The detection of a relative maneuver, according to an embodiment, can be based on position and velocity information received in ADS-B reports.

If, in step 122, it is determined that no relative maneuver has occurred, then processing proceeds to step 130 where it is determined if the method 100 is to continue for collision detection, or if it should be terminated. If, for example, the ownship is close to completing its planned flight, then it may be decided to terminate method 100. Otherwise, processing is returned to step 102 for another iteration of processing method 100.

If, in step 122, it is determined that a relative maneuver has occurred, then in step 124 it is ascertained if that maneuver is a converging maneuver. A converging maneuver is, for example, where the closest point of approach is getting closer to the intruder. If a converging maneuver is detected, then according an embodiment, the PZ is increased in size in step 126. If the detected relative maneuver is not a converging maneuver, then according to an embodiment, the size of the PZ is reduced in step 128. The change in the size of the PZ can be based on the type of one or more of the ownship or intruder, and/or operational considerations. The size of the PZ can also be adjusted based on the quality of measurements (e.g., $NAC_p$ and $NAC_v$ received from ADS-B) and according to an embodiment, the size can be increased or decreased by predetermined size intervals.

According to an embodiment, detecting a maneuver includes the steps of computing the three dimensional CPA and time to CPA based on constant velocity assumption for intruder and other targets; computing the first and second derivative of the minimum distance (squared) to detect converging encounters (i.e., first derivative is negative, second derivative is positive); computing the ray (direction and speed) that represents the change in the Missed Distance (MD) over consecutive an N-samples (N is a predetermined number) moving window; if the target is already predicted to fall within the current PZ, increase the PZ by a factor that is proportional to the radial component of the MD ray velocity with respect to the center of the cylinder; and if the target is projected to fall outside the nominal PZ, compute the time it takes to penetrate the nominal PZ. If the predicted time to penetrate the PZ is less than a predetermined threshold (the threshold would likely to be proportional to relative speed), then increase the PZ by a factor that is proportional to the radial component of the MD ray velocity with respect to the center of the cylinder.

In step 130, it is determined whether the method 100 should be terminated. For example, if the remaining flight time or distance to the planned destination is below a predetermined respective threshold, then method 100 can be terminated shutting down the CD&R system. Otherwise, processing of method 100 can be re-iterated starting at step 102.

Figure 2:
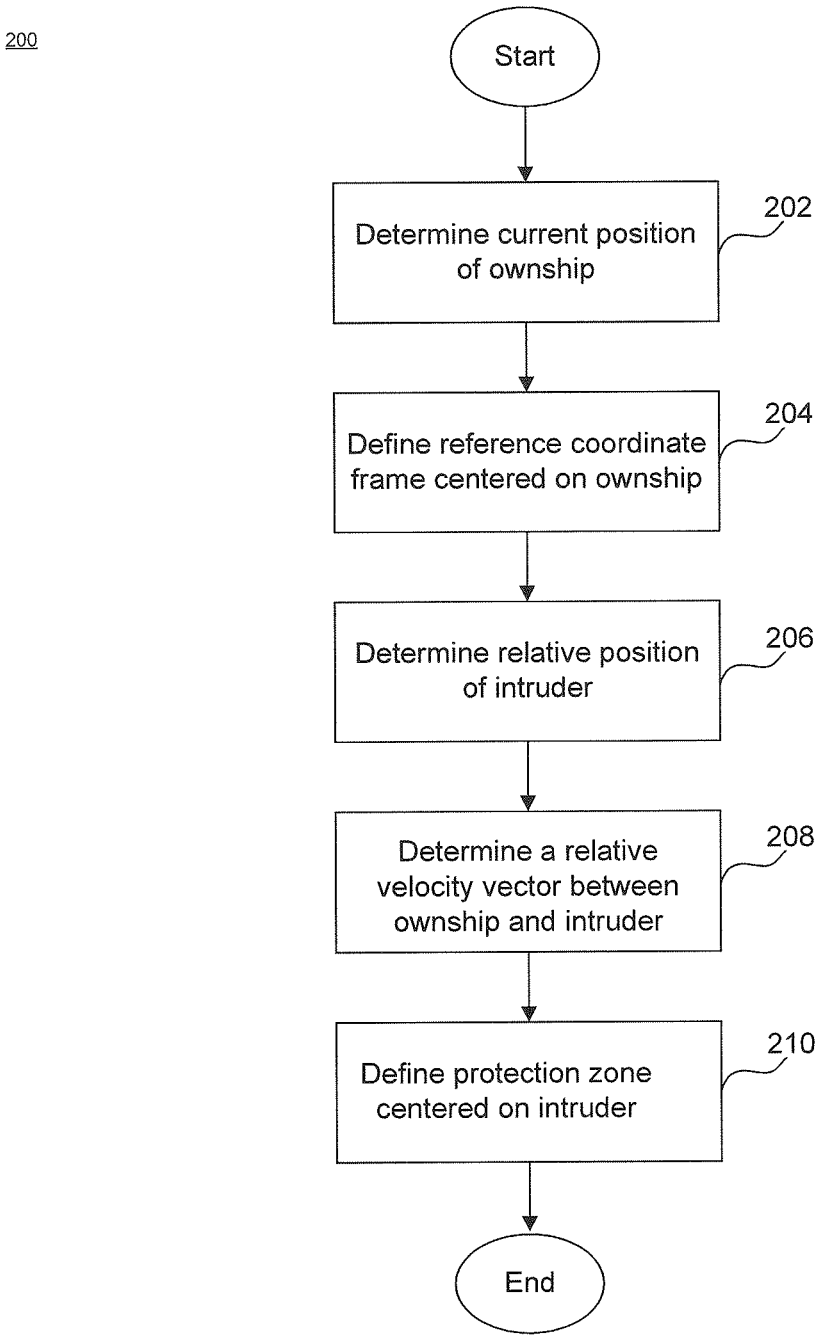
FIG. 2 is a flowchart of a method of for predicting a potential conflict, according to an embodiment of the present invention.

FIG. 2 is a method of for predicting a potential conflict, according to an embodiment of the present invention. In step 202, the current position of the ownship is determined. Position determination can be based upon any known method including latitude, longitude, and elevation coordinates available from ownship on-board detectors.

In step 204, a reference coordinate frame is defined centered on the ownship's current position. According to an embodiment, a local Cartesian North-East-Down (NED) coordinate frame centered on the current ownship position is selected. This coordinate system may be referred to herein as ownship NED. This can require transforming the position information reports received, for example, from ADS-B reports from the standard World Geodesic System WGS-84 coordinate system to the selected NED coordinate frame.

In step 206, the current position of the intruder is determined. According to an embodiment, the position of the intruder is determined as the position of the intruder relative to the ownship. For example, if the absolute position of the intruder is available from monitoring information, then the absolute position can be translated to a relative position relative to the ownship. A relative position can be defined as, for example, a direction and a distance from the ownship to the intruder.

Figure 4B:
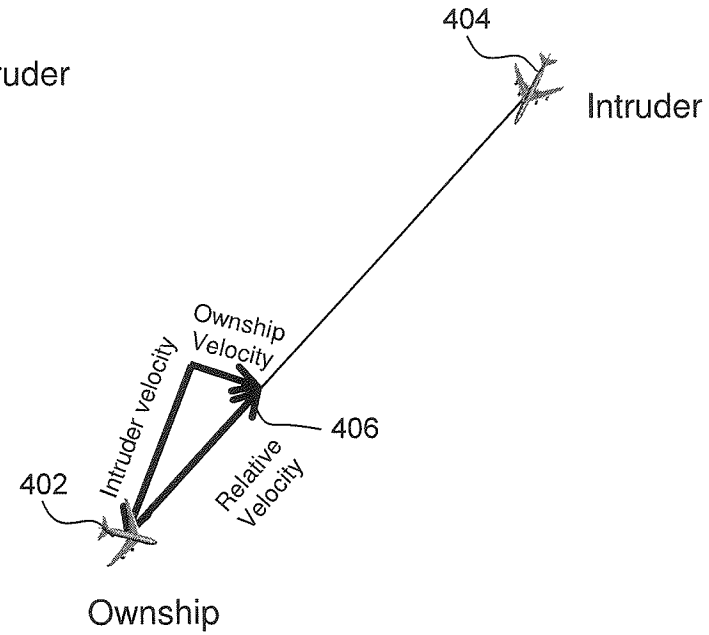
FIGS. 4A and 4B illustrate the relative velocity vector between aircraft, according to an embodiment of the invention.
Figure 4A:
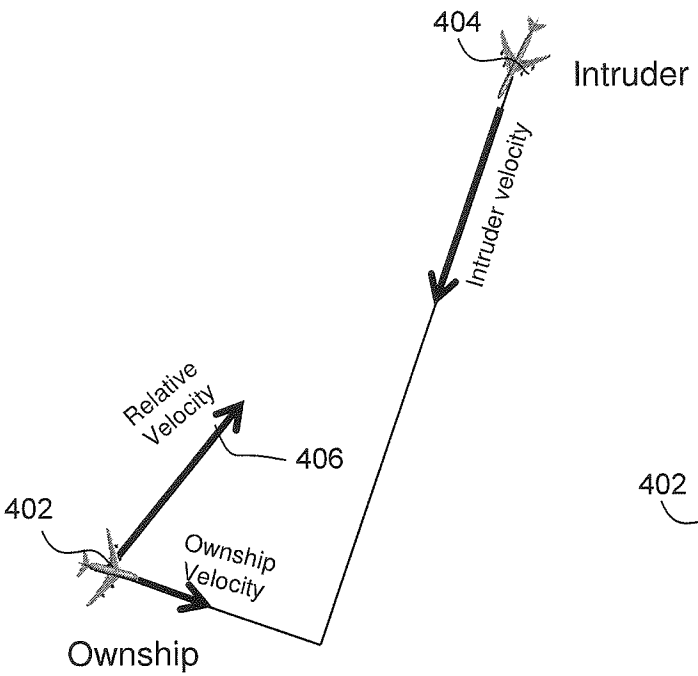

In step 208, a relative velocity vector between the ownship and the intruder is determined. The relative velocity vector $\vec{v}_R$ between ownship velocity $\vec{v}_A$ and intruder velocity $\vec{v}_B$ can be defined as: $\vec{v}_R(t)=\vec{v}_A(t)-\vec{v}_B(t)$. The intruder can then be considered stationary and the ownship future trajectory can be represented by a ray in the direction of $\vec{v}_R$ under the assumption of constant velocities. FIGS. 4*a* and 4*b* graphically illustrate the relative velocity vector between the ownship 402 and intruder 404. FIG. 4A illustrates a representation of the relative velocity 406 of the ownship 402 and intruder 404. FIG. 4B graphically illustrates a representation of the equivalent scenario to FIG. 4A, but the intruder 404 is being considered as stationary. As illustrated, the trajectory of the ownship can be considered along the direction of 406 with the intruder being stationary at current intruder location 404.

In step 210, a PZ is defined surrounding the intruder. According to an embodiment, a PZ that is of a cylindrical shape with flat surface caps on the top and bottom is defined surrounding the intruder. According to an embodiment, the PZ is a cylinder centered on the relative position of the intruder in the ownship NED with its axes aligned to the local horizontal and vertical NED frame. This can require the translation of the intruder's state vector in the ADS-B reports from the WGS-84 frame to the local NED.

FIG. 5 illustrates an exemplary NED coordinate system 506 defined centered at the current ownship position 502, and the PZ 504 corresponding to a selected intruder. As noted above, the PZ is defined as a vertical cylinder centered at the current location of the intruder. The radius and the height of the cylindrical PZ 504 can be initially determined based upon predefined configuration parameters. Predefined configuration parameters for the PZ cylinder can be based upon one or more factors such as the type and performance capabilities of the intruder, distance from the ownship, operational considerations, and other factors. As described above, the cylindrical PZ 504 can be resized subsequently to its initial definition, as the ownship and intruder approach each other.

Figure 3:
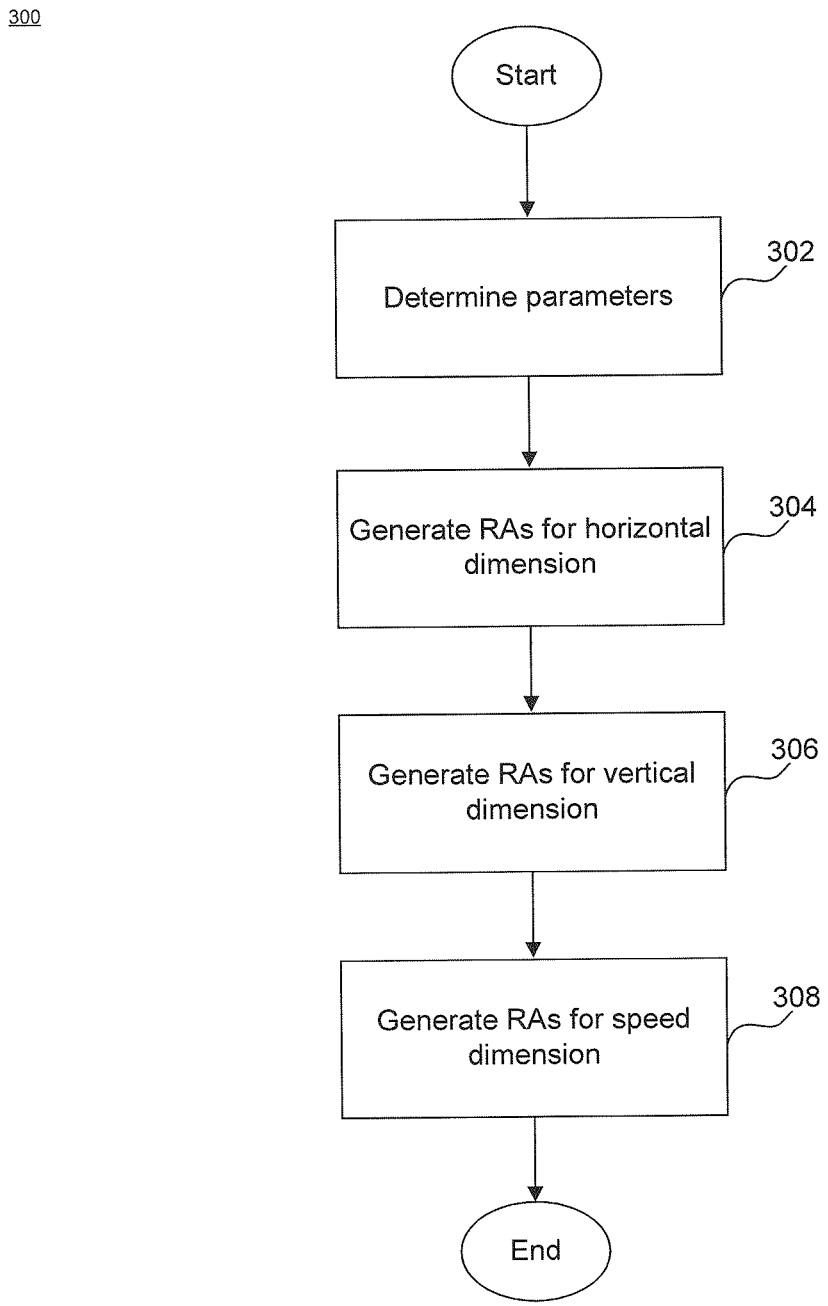
FIG. 3 is a flowchart of a method for generating resolution advisories for a plurality of motion dimensions, according to an embodiment of the present invention.

FIG. 3 illustrates a method 300 for generating RAs for a plurality of motion dimensions, according to an embodiment of the present invention. In step 302, several parameters required for determining the RAs for motion dimensions are determined. According to an embodiment, input parameters are determined based on configuration parameters, information from performance monitoring systems on-board the ownship, and/or based on parameters received from a monitoring system such as, but not limited to, an ADS-B system. The input parameters can include, but are not limited to, ownship and intruder velocities $\vec{v}_A$ and $\vec{v}_B$, ownship flight path angle $\theta_A$ ownship performance constraints such as maximum climb/descent/turn/ground speed, stall speed, radius and height of PZ, and the desired ownship control input duration (i.e., how long a maneuver should last). Input information available from ADS-B can include, for example, intruder identification, location coordinates of the intruder, velocity of the intruder, and uncertainties associated with the location and velocity of the intruder. Input parameters can also include capabilities by type of aircraft, ownship preferences such as maneuver preferences.

In steps 304-308 various RAs for horizontal (ground track left/right dimensions) plane, vertical (up/down dimension) plane, or speed (speed up/slow down) are determined. According to an embodiment, the RAs are determined by formulating the potential conflicts and potential resolutions as geometric problems that can be solved for the motion dimensions of ground track change in left or right turn only, vertical track change as climb or descend only, and speed change as speed up or slow down only resolution. In general, the one or more maneuvers are initiated to alter the flight path of the ownship so that the adjusted path would no longer intersect the PZ surrounding the intruder to cause a conflict.

In step 304, RAs for the ground track (horizontal direction) motion dimension are constructed. According to an embodiment, two RAs are generated for the horizontal direction motion dimension: one RA corresponding to a turn to the left from the current unadjusted path, and a second RA corresponding to a turn to the right from the current adjusted path.

Figure 6B:
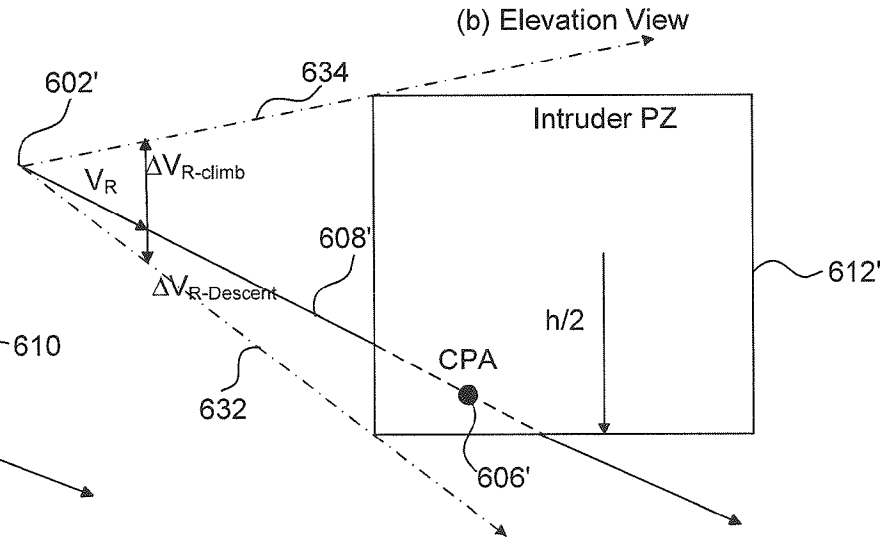
FIGS. 6A and 6B are illustrations of the paths of an ownship aircraft and intruder aircraft and associated conflict detection, according to an embodiment of the present invention.
Figure 6A:
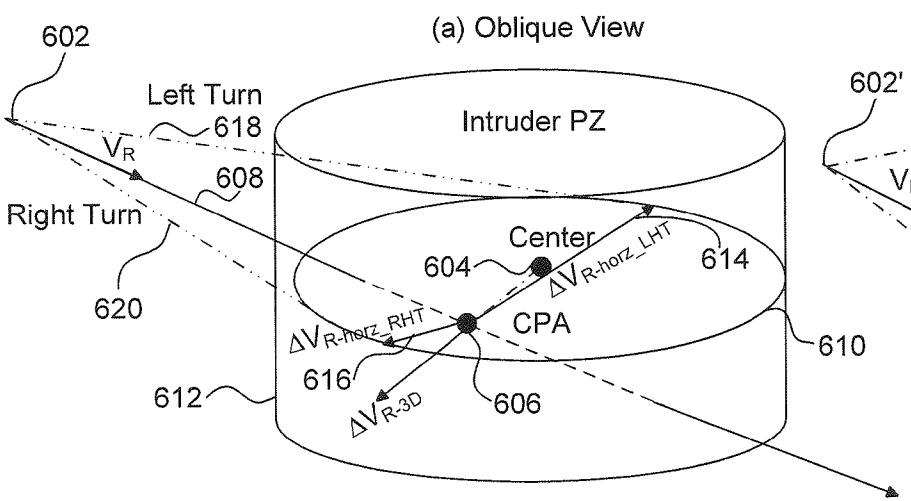

FIG. 6A is a geometric illustration of a scenario in which maneuvers in a horizontal motion to avoid a potential collision can be formulated. A collision resolution solution is to move the CPA 606 along the line connecting the CPA and the center 604 of the PZ 612 (note that the center of the PZ 612 is also the current location of the intruder), shown as $\Delta v_{R_3D}$ in FIG. 6A. A maneuver involving either a heading change, a change in flight path angle, or a change in speed can be implemented to move the CPA 606. FIG. 6A illustrates a collision resolution solution that is accomplished, according to an embodiment, by moving the CPA 606 in the horizontal plane 610 by the vector $\Delta v_{R_horz_LHT}$ 614 for a left hand turn (LHT) or by $\Delta v_{R_horz_RHT}$ 616 for a right hand turn (RHT). FIG. 6B illustrates the vertical maneuvers that will provide collision resolution, and is described below.

Subsequent to determining the required change in relative velocity for the horizontal motion dimension, a corresponding heading change for ownship 602 for a flight path angle for a left hand turn to head in direction 618 or for a right hand turn to head in direction 620 can be determined.

Figure 7:
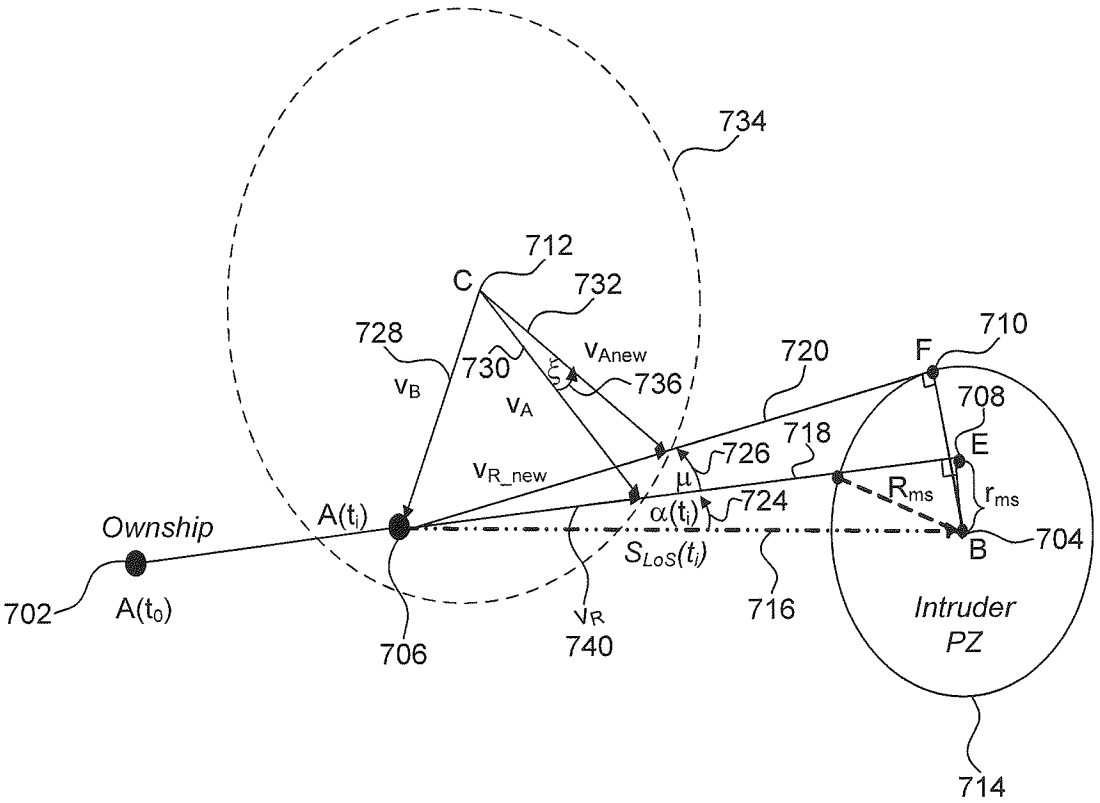
FIG. 7 is illustrates a ground track dimension collision resolution maneuver, according to an embodiment of the present invention.

FIG. 7 graphically illustrates a method, according to an embodiment, for determining the parameters for a ground track change in the horizontal plane that corresponds to a left hand turn. A similar method, but only in a single plane, is described in Bach et al., "An Algorithm for Level-Aircraft Conflict Resolution," NASA Ames Research Center, Moffett Field, Calif., May 31, 2007. The method illustrated in FIG. 7 extends to three-dimensional space and is solved for different parameters than the method in Bach.

As illustrated in FIG. 7, ownship A 702 and intruder B 704 have the shown locations and velocities at time $t_0$. In a Cartesian coordinate system with x-axis pointing North and y-axis pointing East, at a time $t>t_0$, the line of sight (LoS) vector from ownship A (ownship would have moved away from the 702 location) to intruder B 704 (intruder can be considered stationary due to the use of relative motion), in the horizontal plane, is given by its magnitude $S_{LoS}(t)$ and direction $\Psi_{LoS}(t)$, by $$S_{LoS}(t) = \sqrt{(\Delta x(t))^2 + (\Delta y(t))^2} \tag{1}$$

$$\psi_{LoS}(t) = \tan^{-1}\left(\frac{\Delta y(t)}{\Delta x(t)}\right) \tag{2}$$

where $\Psi_{LoS}$ is measured positive clockwise from North and will vary with time (not shown in FIG. 7).

The relative velocity vector 740 between ownship A (location 706 at time $t_i$) and intruder B 704, $\vec{v}_R$, is defined by $$\vec{v}^*_R(t) = \vec{v}^*_A(t) \tag{3}$$

where $\vec{v}^*_A(t)$ 730 and $\vec{v}^*_B(t)$ 728, are the velocities of ownship and intruder 704, respectively. According to an embodiment, under the assumption of constant velocity aircraft, the relative velocity vector is constant. Herein, the velocity vectors are illustrated as a function of time but are denoted with the superscript *, in some instances, to indicate that the corresponding velocities do not change under the assumption of constant velocities. The velocities can be recalculated with every update, or at predetermined intervals, and a separate algorithm can be used to adapt to a velocity change by adjusting for the PZ volume. The circle 714 centered on the intruder B 704 has a radius $R_{ms}$, which is minimum separation to avoid conflict (radius of the cylindrical PZ 714). The intruder can be considered stationary, while ownship proceeds along the relative velocity vector 740. As long as the velocity vectors 740 remain constant, ownship proceeds along the ray in the direction of the relative velocity 740 and the CPA will remain at point E 708.

According to an embodiment, a time $t_i$ in the future when a change in the ownship velocity heading must be executed to direct the relative velocity along the line tangent to the PZ, can be determined. This dynamic real-time determination of the alert time for respective RAs, according to embodiments of the present invention, increases the efficiency of the CD&R. According to an embodiment, in computing the respective alert times, any changes in ownship velocity vector calculation can take ownship performance restraints into account.

This technique is illustrated in FIG. 7, where ownship velocity, $\vec{v}_A$, and intruder velocity, $\vec{v}_B$, are the vectors 730 and 728, respectively, located at the center C 712 of the dashed circle 734. FIG. 7 illustrates the translation of the pair-wise encounter between the ownship A and intruder B into the relative frame at ownship A. Translation into the relative coordinate system enables simpler and more efficient computation. The circle 734, with radius corresponding to $\vec{v}_A$ shows the vector endpoints for all possible new ownship velocity vectors. It should be noted that the lengths of the ownship velocity vectors before and after the maneuver, $\vec{v}_A$ 730 and $\vec{v}_{A_new}$ 732, do not change although, in this embodiment, a change in the direction of the ownship occurs.

The magnitude of the relative velocity can be determined according to $$v^*_R(t)=\sqrt{N^2(t)+E^2(t)} \tag{4}$$

$$N(t)=v^*_A(t)\cos\psi_A(t)-v^*_B(t)\cos\psi_B(t) \tag{5}$$

$$E(t)=v^*_A(t)\sin\psi_A(t)-v^*_B(t)\sin\psi_B(t) \tag{6}$$

where the heading angles for ownship and intruder, $\Psi_{A(t)}$ and $\psi_{B(t)}$, respectively, are measured positive clockwise from North will vary with time.

The heading of the relative velocity vector can be determined according to $$\psi^*_R(t) = \tan^{-1}\left(\frac{E(t)}{N(t)}\right) \tag{7}$$

Define the angle $\alpha(t)$ 724 as the difference between the LoS heading 716 and relative heading 718, measured clockwise.

$$\alpha(t)=\psi^*_R(t)-\psi_{LoS}(t) \tag{8}$$

The CPA 708 is represented by the segment BE. Its length can be computed from the current LoS distance $S_{LoS}(t_0)$ and the current angle $\alpha(t_0)$ $$\begin{aligned} r^*_{ms}(t) &= S_{LoS}(t)\sin(\alpha(t)) \\ &= S_{LoS}(t_0)\sin(\alpha(t_0)) \end{aligned} \tag{9}$$

It should be noted that $r_{ms}(t)$ will be constant for constant velocity aircraft (indicated by the superscript "*").

To determine the maneuver alert time $t_i$ (i.e., the onset of resolution maneuver), the relative velocity angle change, $\mu$ 726, can be determined. This angle is derived from the achievable heading change, $\xi_{A/C}$, of ownship given by:

$$\xi_{A/C}=(\omega-\omega_C)\Delta T_{ICD} \tag{10}$$

where $\omega$ is the maximum turn rate, $\omega_c$ is the current turn rate, and $\Delta T_{ICD}$ is the desired input control duration that can be preconfigured.

The ownship heading angle, $\xi_{A/C}$, is then projected into the horizontal plane to find the horizontal component $\xi$. For any flight path angle, $\sigma$, the projected horizontal heading angle is given by:

$$\xi = \tan^{-1}\left(\frac{\tan\xi_{A/C}}{\cos\sigma}\right) \tag{11}$$

From the horizontal ownship heading change, $\xi$ 736, the angle change $\mu$ 726 can be determined for the relative velocity. The ownship velocity vector before and after the heading change by $\xi$ can be determined according to:

$$\begin{aligned} \bar{v}_A(t) &= v^A_x(t)\hat{i} + v^A_y(t)\hat{j} \\ &= R_A(t)\cos\theta_A(t)\hat{i} + R_A(t)\sin\theta_A(t)\hat{j} \end{aligned} \tag{12}$$

$$\bar{v}_{A_new}(t)=R_A(t)\cos(\theta_A(t)+\xi)\hat{i}+R_A(t)\sin(\theta_A(t)+\xi)\hat{j} \tag{13}$$

where $\theta_A$ is the ownship ground track angle measured clockwise from the north.

The relative velocity before and after ownship heading change, respectively, $\bar{v}_R(t)$ and $\bar{v}_{R_new}(t)$ can be determined according to (14) and (15)

$$\begin{aligned} \bar{v}_R(t) &= \bar{v}_A(t) - \bar{v}_B(t) \\ &= (R_A(t)\cos\theta_A(t) - R_B(t)\cos\theta_B(t))\hat{i} + \\ &\quad (R_A(t)\sin\theta_A(t) - R_B(t)\sin\theta_B(t))\hat{j} \end{aligned} \tag{14}$$

$$\begin{aligned} \bar{v}_{R_new}(t) &= \bar{v}_{A_new}(t) - \bar{v}_B(t) \\ &= (R_A(t)\cos(\theta_A(t) + \xi) - R_B(t)\cos\theta_B(t))\hat{i} + \\ &\quad (R_A(t)\sin(\theta_A(t) + \xi) - R_B(t)\sin\theta_B(t))\hat{j} \end{aligned} \tag{15}$$

where $\theta_B$ is the intruder ground track angle measured clockwise from the north.

Angle $\mu$ 726 between the old 740 and new 720 relative velocity vector in the horizontal plane can be determined according to (16)

$$\mu(t) = \cos^{-1}\left(\frac{\bar{v}_{R_new}(t)\cdot\bar{v}_R(t)}{|\bar{v}_{R_new}(t)||\bar{v}_R(t)|}\right) \tag{16}$$

In FIG. 7, triangle AEB, with vertices 706, 708, and 704, represents the relationship between the ownship (at location 706), the CPA based on the unadjusted path of the ownship (E at location 708) and the intruder (considered stationary at location 704 due to the use of relative velocity), at the time $t_i$ when a change in a motion dimension is to be implemented in the ownship. From triangle AEB, (17) can be determined.

$$\sin\alpha(t_i) = \frac{r^*_{ms}(t)}{S_{LoS}(t_i)} \tag{17}$$

Triangle AFB, with vertices 706, 710, and 704, represents the relationship between the ownship (at location 706), the CPA based upon the projected path after the implementation of the adjustment of the motion dimension (E at location 708), and the intruder (considered stationary at location 704 due to the use of relative velocity), at the time $t_i$ when a change in a motion dimension is to be implemented in the ownship. From triangle AFB, (18) can be determined.

$$\sin\beta(t_i) = \frac{R_{ms}}{S_{LoS}(t_i)} \tag{18}$$

By substituting for $\beta(t_i)$, $$\begin{aligned}\sin\beta(t_i) &= \sin(\alpha(t_i) + \mu) \\ &= \sin\alpha(t_i)\cos\mu + \cos\alpha(t_i)\sin\mu \\ &= \frac{R_{ms}}{S_{LoS}(t_i)}\end{aligned} \tag{19}$$

Dividing (19) by (17), $$\frac{\sin\alpha(t_i)\cos\mu + \cos\alpha(t_i)\sin\mu}{\sin\alpha(t_i)} = \frac{R_{ms}}{r^*_{ms}(t)} \tag{20}$$

Solving for $\alpha(t_i)$, $$\alpha(t_i) = \cot^{-1}\left(\frac{R_{ms}}{r^*_{ms}(t)\sin\mu} - \cot\mu\right) \tag{21}$$

The distance between A 706 and E 708, represents the distance remaining to the CPA (based on the unadjusted path of the ownship) at the time the path adjustment is to be implemented. The AE segment can be determined as, $$\overline{AE} = \frac{r^*_{ms}(t)}{\tan|\alpha(t_i)|} \tag{22}$$

Based upon the above, the maneuver time from A to E is given by $$t_{AE} = \overline{AE}/|v^*_R(t)| = \frac{r_{ms}/\tan|\alpha(t_i)|}{|v^*_R(t)|} \tag{23}$$

To compute the time to the onset of the alert, $t_{RA}$, an augmented $t_{AE}$ value is subtracted from the estimated time to CPA, $t_{CPA}$, $$t_{RA} = t_{CPA} - t_{AE_augmented} \tag{24}$$

The $t_{AE}$ is augmented by the actuation response time (e.g., aircraft-specific delay to implement the maneuver command), $\Delta T_{ART}$, and the pilot response delay, $\Lambda$.

$$t_{AE_augmented} = t_{AE} + \Delta T_{ART} + \Lambda \tag{25}$$

If this is the best solution after the down-select process, at the time of $t_{AE_augmented}$ (i.e., alert time according to (25)), a RA can be transmitted to the ownship, or other entity controlling the ownship, with a turn angle of $\xi_{A/C}$ (according to (10) above).

Similarly to the above, a RA for a right hand turn in the horizontal dimension to avoid the potential collision can be generated. The two RAs in the horizontal dimension (e.g., left hand turn and right hand turn) can then be used for further processing.

Figure 8A:
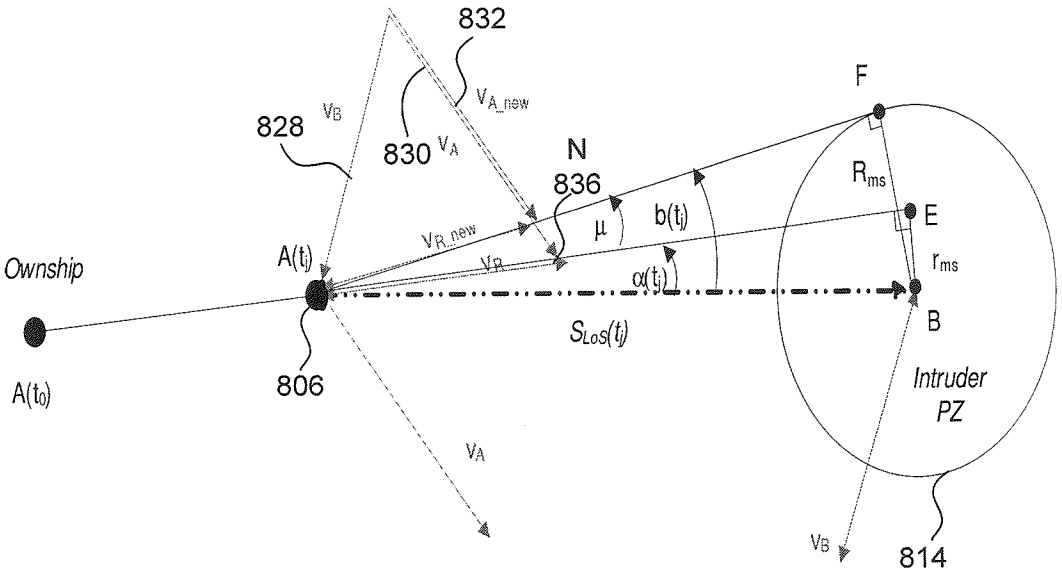

In step 306, a plurality of RAs corresponding to the motion dimension of speed are generated. Unlike the heading change maneuvers, a speed change maneuver can result in solutions both in the horizontal and vertical planes. This, for example, occurs if the relative velocity vector is not confined to the horizontal plane. According to an embodiment, an initial down-select algorithm can be used to determine the best two solutions for this maneuver type. FIG. 8A geometrically illustrates a scenario for determining the alert time for a RA that includes a maneuver in the horizontal dimension decreasing speed. The direction of the old and new ownship velocity vectors, $\vec{v}_A$ 830 and $\vec{v}_{A_new}$ 832, is the same. However, the length of the vector $\vec{v}_{A_new}$ 832 can be less than $\vec{v}_A$ 830. The alert time to avoid the PZ 814 by moving the ray corresponding to the unadjusted path of the ownship to the left side (e.g. left surface or further) of the PZ cylinder 814.

The change in ownship speed, $\Delta v^*_A(t)$, can be determined according to, $$v^*_A(t) + \Delta v^*_A(t) = v^*_{A_new}(t) \tag{26}$$

For a resolution that slows the ownship to minimum allowable speed, the following constraint can be satisfied:

$$v^*_A(t) + \Delta v^*_A(t) \geq v_{min} \tag{27}$$

For a resolution that accelerates the ownship to maximum allowable speed, the following constraint can be satisfied:

$$v^*_A(t) + \Delta v^*_A(t) \leq v_{max} \tag{28}$$

The minimum and maximum allowable speeds are assumed to be aircraft specific known performance parameters, and can be preconfigured. Thus, a change in ownship speed is bounded by $$v_{min\,x} - v^*_A(t) \leq \Delta v^*_A(t) \leq v_{max} - v^*_A(t) \tag{29}$$

Figure 8B:
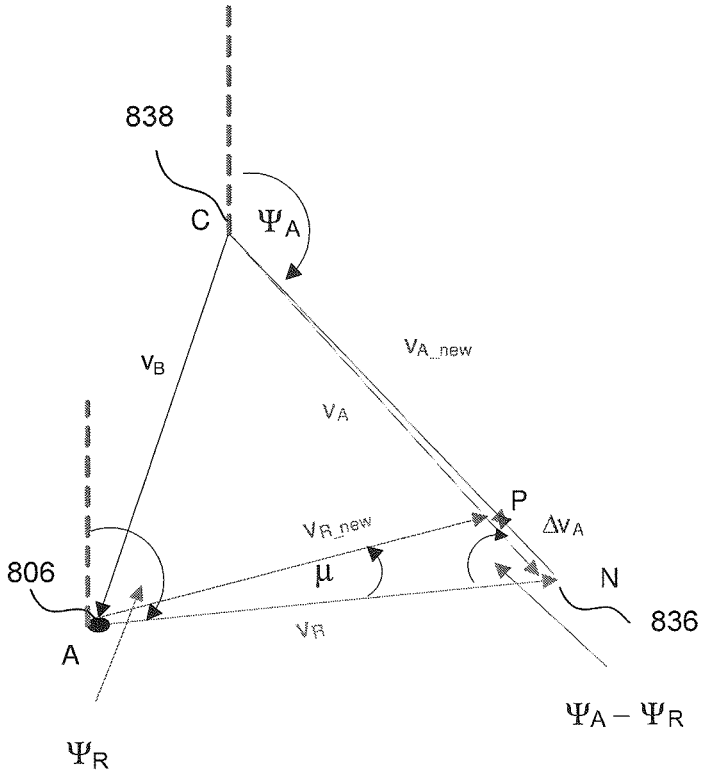

The relative speed can be computed as in (4) above. FIG. 8B illustrates (30)-(32) geometrically. A triangle can be considered having vertices A 806 corresponding to the location of the ownship at the time of implementing the RA, N 836 corresponding to the intersection of the unadjusted relative velocity and ownship velocity, and C 838 corresponding to the intersection of the adjusted relative velocity and adjusted ownship velocity. Applying the Law of Cosines to the triangle ACN in FIG. 8B, the adjusted relative velocity can be determined.

$$v_{R_new}^2(t) = \Delta v_A^2(t) + v_R^2(t) - 2\Delta v_A(t) v_R(t)\cos(\Psi_A(t) - \Psi_R(t)) \tag{30}$$

Where the relative speed $\vec{v}_R$ is determined according to (3).

The Law of Sines can be applied to the triangle APN as in (31).

$$\frac{\Delta v_A(t)}{\sin\mu} = \frac{v_{R_new}(t)}{\sin(\Psi_A(t) - \Psi_R(t))} \tag{31}$$

Solving for the relative heading change due to the track speed maneuver, $$\mu(t) = \sin^{-1}\left(\frac{\Delta v_A(t)\sin(\Psi_A(t) - \Psi_R(t))}{v_{R_new}(t)}\right) \tag{32}$$

Equations (21)-(25) can be used to determine the alert time for this decrease speed maneuver using the expression for the angle μ(t) computed above. A similar approach is taken for the increase speed maneuver and is not shown here.

Similar to the generation of the RA for the decrease in speed in the horizontal direction, according to an embodiment, RAs are generated for the increase in speed in the horizontal direction, decrease in speed in the vertical direction, and increase in speed in the vertical direction can be generated. A subsequent down-selection process, for example, based upon a preference for either horizontal or vertical maneuvers, can select two RAs for further processing.

In step 308, a plurality of RAs corresponding to the vertical motion dimension to climb or descend are generated. FIG. 6B illustrates a CD&R scenario in the vertical motion dimension, according to an embodiment of the present invention. 612' is the PZ shown in the vertical dimension, and 602' is the current location of the ownship. Ownship's relative velocity vector $\vec{v}_R$ 604' is shown passing through CPA 610'. Based upon the resolution, ownship can climb to an angle of $\Delta V_{R\text{-}climb}$ from $\vec{v}_R$ and continue along 634 so that it can go above the front top edge of the PZ cylinder, or can descend $\Delta V_{R\text{-}descend}$ from $\vec{v}_R$ and continue along 632 so that it can go below the front bottom edge of the PZ cylinder. In either resolution, the ownship avoids the PZ by changing its vertical direction.

FIG. 9, for example, illustrates an approach for solving the geometric problem that will yield the alert time to vertical climb maneuver. FIG. 9 illustrates the vertical plane that contains the relative velocity vector. As illustrated in FIG. 9, the relative velocity vector is not restricted to the horizontal plane. The reference coordinate for angles in FIG. 9 are as follows: γ 946 is measured from the horizontal plane (where the horizontal component of the relative velocity vector $V_{R_horz}$ 948 is located) to the relative velocity vector 950; a 954 is measured from the LoS vector 916 to the relative velocity vector 950; β 956 is measured from the LoS vector 916 to new relative velocity vector 952; and μ 958 is measured from the relative velocity vector 950 to new relative velocity vector 952. As illustrated in FIG. 9, the new relative velocity vector 952 is determined, so that instead of heading on a path to CPA E 908 and intersecting the PZ cylinder at G 942, the ownship is now directed to be above the top surface of the PZ cylinder 914 (e.g., point F 944 at the top edge of the cylinder). The center of the PZ, and the intruder, are located at 904.

The climb/descent angle of the relative velocity vector can be measured from the horizontal plane according to (33).

$$\gamma_R^*(t) = \tan^{-1}\left(\frac{v_{R_vert}^*(t)}{v_{R_horz}^*(t)}\right) \tag{33}$$

To compute the maximum relative climb/descent angle that can be supported by ownship's maximum climb rate, it can be assumed that the ownship maintains constant velocity throughout the climb/descent maneuver. The relationship between the current ownship climb/descent rate, speed, $\vec{v}_A$, and flight path angle, $\theta_A$, can be specified as in (34).

$$\frac{dz_A(t)}{dt} = v_A^*(t)\sin\theta_A^*(t) \tag{34}$$

The maximum ownship climb, $\theta^*_{climb}(t)$, and descent, $\theta^*_{descent}(t)$, angles that can be achieved with known maximum climb and descent rates, can be computed based upon (35) and (36).

$$\theta_{climb}^*(t) = \sin^{-1}\left(\frac{dz_A(t)\,|_{max_climb}\ /dt}{v_A^*(t)}\right) \tag{35}$$

$$\theta_{descent}^*(t) = \sin^{-1}\left(\frac{dz_A(t)\,|_{max_descent}\ /dt}{v_A^*(t)}\right) \tag{36}$$

where, max climb rate=$dz_A(t)|_{max_climb}/dt$ max descent rate=$dz_A(t)|_{max_descent}/dt$ Based upon the above, the maximum relative velocity angular change $\mu^*_{descent}(t)$ and $\mu^*_{climb}(t)$ that can be achieved are determined according to (37) if ownship is currently descending, and (38) if ownship is currently climbing.

$$\mu^*_{descent}(t)=\theta^*_{descent}(t)-\text{abs}(\theta^*_A(t)) \tag{37}$$

$$\mu^*_{climb}(t)=\theta^*_{climb}(t)-\text{abs}(\theta^*_A(t)) \tag{38}$$

Based upon the achievable climb/descent relative velocity angle, μ, the segment $\overline{AF}$ can be determined.

From FIG. 9, for a climbing maneuver, the angle of AGF is equal to $\Pi-\Psi_R$. Vertices A 906, G 942, and F 944 correspond, respectively, to the ownship location at the time the climb/descend maneuver is initiated, the point at which the unadjusted path of the ownship would intersect the PZ cylinder, and the point at which the adjusted path (i.e. path after the climb maneuver is implemented) touches or comes close to, the top edge of the PZ cylinder.

Using the Law of Sines on triangle AGF, $$\frac{\Delta ALT}{\sin\mu} = \frac{\overline{AF}}{\sin(\prod - \Psi_R^*(t)))} \tag{39}$$

Solving for the AF segment, we have $$\overline{AF} = \frac{\Delta ALT * \sin(\prod - \Psi_R^*(t)))}{\sin\mu} \tag{40}$$

Solving for the time required to execute the climb resolution, we have $$t_{AF}=\overline{AF}/|v^*_R(t) \tag{41}$$

To compute the remaining time to the onset of the alert, $t_{RA}$, the augmented $t_{AF}$ is subtracted from the estimated time to CPA, $t_{CPA}$.

$$t_{RA}=t_{CPA}-t_{AF_augmented} \tag{42}$$

The $t_{AF}$ is augmented by the actuation response time (aircraft-specific delay to the maneuver command), $\Delta T_{ART}$, and the pilot response delay, A.

$$t_{AF_augmented}=t_{AF}+\Delta T_{ART}+\Lambda \tag{43}$$

If a climb is the best solution after the down-select process, at the time of $t_{AF_augmented}$, a RA with a climb angle of $\mu^*_{climb}(t)$ can be transmitted to the ownship and/or other entity capable of initiating a maneuver in the ownship.

Similarly to the above, a RA for descending in the vertical dimension in order to avoid the potential collision can be generated. The two RAs in the vertical dimension can then be used for further processing.

Another Method Embodiment

FIG. 10 illustrates another method 1000 for CD&R, according to an embodiment of the present invention. Method 1000 enables a method of determining RAs for all dimensions and different points of intersection of the PZ in a generalized manner.

In step 1002, the relative velocity vector $v_R$ of the ownship and intruder is determined. According to an embodiment, $v_R$ may be determined as described in relation to step 208 above.

In step 1004, based on the relative velocity vector $v_R$, the point P1 at which the ownship is expected to intercept the PZ is determined. According to an embodiment, P1 can be determined as described in relation to step 104 above.

In step 1006, for each type of conflict avoidance maneuver, the relative velocity vector $v_{R_new}$ representing the relative velocity after the maneuver is determined assuming that the maneuver is implemented at the current point $t_0$ in time.

For each maneuver, according to an embodiment, the maximum change that the ownship is capable of making can be determined based upon a preconfigured lookup table or other configuration information. For example, in the vertical direction, a maximum climb angle and a maximum descent angle for the type of ownship aircraft can be preconfigured in a lookup table. In this step, according to an embodiment, the new relative velocity vector is determined for each maneuver based on the capabilities of the ownship that can be determined, for example, based on a lookup table. According to an embodiment, the determining of the multiple maneuvers can be performed in a manner similar to that described with respect to FIG. 5 above.

In step 1008, it is determined for each maneuver, whether the maneuver would lead to $v_{R_new}$ intercepting PZ if the maneuver is implemented at the present time $t_0$. If the particular maneuver, even if implemented immediately based upon the maneuver capabilities of the ownship aircraft, intercepts the PZ, then it is assumed that the particular maneuver cannot yield a conflict avoidance solution and is not included in further considerations.

In step 1010, it is determined whether the current location $A(t_0)$ of the ownship lies above the top cap of the PZ, below the bottom cap of the PZ, or in between the cap planes.

In step 1012, it is determined for each maneuver, whether $v_R$ intercepts the PZ at a location of the cap of the PZ, or on a lateral side of the PZ.

If it is determined in step 1012 that the interception point P1 is at the top or bottom caps of the PZ, then steps 1014-1032 are performed to determine the corresponding resolution alert time. In step 1014, it is determined if the maneuver has a component orthogonal to the cap. If, for example, the maneuver has a component orthogonal to the cap plane, it corresponds to the $v_{R_new}$ having a component orthogonal (i.e., pointing out and away) from the cap plane. According to an embodiment, the test $N_{cap}\cdot v_{R_new}\geq 0$ can be used as the test to make the determination, in which case the maneuver can be lessened so that ownship will slightly pass over/under and parallel to the top/bottom cap. $N_{cap}$ represents a component orthogonal to the maneuver plane.

$$\begin{aligned} v_{R_new} &= ((v_{A_new}-v_B)) \\ &= (v^x_{A_new}-v^x_B)\hat{i}+(v^y_{A_new}-v^y_B)\hat{j}+(v^z_{A_new}-v^z_B)\hat{k} \\ &= (v_{A_new}-v_B) \\ &= (v^x_{A_new}-v^x_B)\hat{i}+(v^y_{A_new}-v^y_B)\hat{j}+(v^z_{A_new}-v^z_B)\hat{k} \\ &= v^x_{R_new}+v^y_{R_new}+v^z_{R_new} \end{aligned} \tag{44}$$

(44) illustrates $v_{R_new}$, $v_{A_new}$ (ownship absolute velocity after maneuver), $v_B$ (intruder velocity) in their component form for x, y, and z directions. Based on (44), the component of $v_{R_new}$ that is orthogonal to the maneuver plane can be determined as (45) below.

$$=>v_{R_new}{}^z=(-v^{}{}_A\sin\theta^{}+v_B\sin\theta_B) \tag{45}$$

$v^{}{}_a$, $v_B$, $\theta^{}$, $\theta_B$, represent respectively, maximum changeable velocity for ownship, velocity of intruder, adjusted minimum climb/descent angle, climb/descent angle of intruder, and maximum climb/descent angle for ownship.

If $N_{cap}\cdot v_{R_new}=0$, then $v_{R_new}$ is already parallel to the cap and a full maneuver should be used. The maneuver can occur at the cap surface and the resolution alert time is determined accordingly in step 1018. The resolution time may also be available from an earlier determination of the interception point. The resolution alert time for the maneuver can be recorded in a table that records information regarding each of the potential maneuvers for the ownship, in step 1022.

If $N_{cap}\cdot v_{R_new}>0$, then $v_{R_new}$ has a component orthogonal to the cap plane. In step 1020, a maneuver sufficient to make $v_{R_new}$ parallel to the cap plane is determined.

$$\begin{aligned} &(-v^{}_A\sin\theta_{new_min}+v_B\sin\theta_B)=0 \\ &\theta_{new_min}=\sin^{-1}\left(\frac{v_B}{v_A}\sin\theta_B\right) \\ &\text{where } -1\leq\frac{v_B}{v_A}\sin\theta_B\leq 1 \quad \therefore \\ &\qquad |\theta_{new_min}|<|\theta^{}| \text{ where } -90^\circ<\theta_{new_min}<90^\circ \end{aligned} \tag{46}$$

Based on (46) above, the ownship climb or descent maneuver can be determined to achieve level off of the relative horizontal velocity. Since the maneuver may occur at the cap surface, the resolution alert time can be determined accordingly. The resolution alert time for the maneuver can be recorded in a table in step 1022.

If $N_{cap}\cap v_{R_new}<0$, then the maneuver must be initiated before the PZ is penetrated. In step 1024, it is determined whether the path of the ownship can be changed such that the current point P1 of penetrating the PZ can be moved to the rim of the cylinder cap. For example, it is determined whether the intersection point P2 of the $v_{R_new}$ and v12 can be moved along line v12 to the edge of the PZ cap. v12 is the line defining the intersection of the plane of the maneuver (e.g. the plane having $v_R$ and $v_{R_new}$) and the plane of the corresponding cap.

From the one or more solutions for P2 determined in step 1024, the P2 that is located in the maneuver half plane is selected in step 1026. The maneuver half plane is the plane area on the maneuver plane between $v_R$ and $v_{R_new}$.

In step 1028, it is determined whether $v_{R_new}$ at P2 penetrates the PZ. This can occur, for example, when $v_{R_new}$ approaches the PZ at such an angle that it initially intercepts the PZ at the cap edge, and continues into the PZ.

If in step 1028, it is determined that $v_{R_new}$ at P2 penetrates PZ, in step 1030, it is determined if there is a conflict avoidance solution such that $v_{R_new}$ can be adjusted such that it is tangent to the corresponding lateral side of the PZ cylinder. If a solution tangent to a lateral side exists, the corresponding resolution alert time is determined and recorded in step 1022.

If in step 1030 it is determined that $v_{R_new}$ cannot be adjusted, $v_{R_new}$ is adjusted so that it can intercept the PZ at the opposite side of the cap edge from the current intercept position. The corresponding resolution alert time is determined and recorded in step 1022.

The resolution alert times may have been recorded for each maneuver was recorded in step 1022 when each maneuver was determined. Further processing of the recorded resolution alert times can be performed in order to adjust for factors such as actuation durations and pilot delays. The pilot delay, for example, can be aircraft specific (e.g., manned or unmanned) and/or be based on operational mode (e.g., autonomous or manual).

If in step 1014 it was determined that the interception point for the particular maneuver is not at a cap of the PZ, then steps 1040-1044 are performed to determine aspects of intercepting the PZ at a lateral side of the PZ and corresponding resolution alert times. In step 1040, it is determined if $v_{R_new}$ includes a component in the direction of surface normal. According to an embodiment, based on points P1 and Pc, the surface normal $N_{surface}$ at the intersection of PZ and $v_R$, is determined. For example, $N_{surface}=(x1-xc, y1-yc, 0)$, where P1=(x1, y1, z1) and Pc=(xc, yc, zc). Pc is the relative current location of the intruder. The x, y, and z components of P1 and Pc may represent the respective location coordinate parameters in horizontal and vertical dimensions. If $v_{R_new}$ includes a component in the direction of the surface normal, then $N_{surface} \cdot v_{R_new} \geq 0$.

If $N_{surface} \cdot v_{R_new} < 0$, then in step 1042 it is determined if there is a solution (e.g. $v_{R_new}$) that is tangent to the PZ surface. If there is a solution tangent to the PZ surface, then the corresponding resolution alert time is determined and recorded in step 1022. If there is no solution that is tangent to the PZ surface at the current edge, then in step 1044 it is determined whether a $v_{R_new}$ can be determined with respect to the edge of the PZ that is opposite with respect to the current incidence of $v_{R_new}$.

If $N_{surface} \cdot v_{R_new} = 0$, then $v_{R_new}$ is already parallel to the surface 1046 and a full maneuver should be used. The maneuver can occur at the surface and the resolution alert time is determined accordingly in step 1048. The resolution time may also be available from an earlier determination of the interception point.

If $N_{surface} \cdot v_{R_new} > 0$, then $v_{R_new}$ is not parallel to the surface. In step 1050, a maneuver sufficient to make $v_{R_new}$ parallel to the surface is determined. The resolution alert times for each of the maneuvers can be recorded in a table that records information regarding each of the potential maneuvers for the ownship, in step 1022.

When step 1044, 1046, or 1050 are completed for respective maneuvers and all potential maneuvers have been processed according to method 100, a table can hold the respective resolution alerts and corresponding resolution alert times. The final selection of the resolution alert to be issued to the ownship can be selected based, for example, on a down selection process such as that described with respect to FIG. 1. According to an embodiment, for example, the resolution alert with the latest resolution alert time can be selected to be transmitted to the ownship and/or other control entity for the ownship.

Example System Embodiments

FIG. 13 illustrates a CD&R system 1300, according to an embodiment of the present invention. CD&R system 1300, according to an embodiment, implements the functions described above in relation to FIG. 1. CD&R system 1300 can comprise an input parameter collector 1302, a maneuver detector 1304, a relative trajectory determiner 1306, a PZ determiner 1308, a CD&R mode changer 1310, a RA generator 1312, a horizontal dimension RA generator 1314, a vertical dimension RA generator 1316, a speed RA generator 1318, an alert time determiner 1320, a per-motion dimension RA selector 1322, a final RA selector 1324, a RA transmitter 1326.

Input parameter collector 1302, according to an embodiment, includes the functionality to receive input parameters from antennas and other types of monitors regarding position and velocity of ownship and intruder. For example, position and velocity information can be received in the form of ADS-B reports, GPS readings, radar readings, and the like. Input parameter collector 1302 can also include the functionality to access configuration information, such as, but not limited to, aircraft type, aircraft capabilities, aircraft preferences, pilot capabilities and preferences, preprogrammed flight plan information, and the like. Input parameter collector 1302 can include the functionality to permit the user enter and/or modify configuration parameters.

Maneuver detector 1304, according to an embodiment, includes the functionality to monitor the approach of the ownship and one or more intruders in relation to each other. Maneuver detector 1304 can, using information obtained from the input parameter collector 1302 or an associated data store, determine the current locations, speeds, and directions of the ownship and one or more intruders. Maneuver detector 1304 can also determine the changes in position of the ownship and the one or more intruders in relation to respective initial positions in a monitoring cycle. According to an embodiment, maneuver detector 1304 continually determines the CPA associated with the ownship and selected intruder in order to determine if either aircraft performs a maneuver during a monitoring cycle.

Relative trajectory determiner 1306 includes the functionality to determine the relative paths of the ownship and one or more intruders. According to an embodiment, a relative motion vector (relative to the ownship) is determined for each intruder. As described above in relation to FIG. 1, considering the motion of a pair of aircraft as a relative motion between that pair, enables one to model the scenario with an intruder that can be considered stationary.

Protection zone determiner 1308 includes the functionality to determine a PZ, or an area inside of which a conflict can be considered to occur around an intruder. According to an embodiment, a PZ is defined in the shape of a vertical cylinder with predetermined radius and height and with planar end caps. Protection zone determiner 1308 can also include the functionality to reconfigure the PZ (e.g., radius of the PZ) in response, for example, to ongoing maneuvers by the ownship and/or the intruder. Protection zone determination and reconfiguration is described above in relation to FIG. 1.

Mode changer 1310 includes the functionality to change the CD&R mode of the ownship. According to an embodiment, mode changer 1310 can configure or initiate the configuration of the ownship in one or two modes: a navigation mode, and a collision avoidance mode. In the navigation mode, no conflict is currently predicted and the ownship periodically executes collision detection, for example, by a method such as method 100. In the conflict avoidance mode, there currently is a predicted conflict and corresponding RAs are generated and selected. In the conflict avoidance mode, further monitoring will take place to detect any maneuvers executed by the ownship and/or intruder.

Resolution advisory generator 1312 includes functionality to generate one or more RAs for each of a plurality of motion dimensions. According to an embodiment, RA generator comprises a horizontal dimension RA generator 1314, a vertical dimension RA generator 1316, and a speed RA generator 1318. Generation of RAs is described above in relation to FIGS. 1 and 3.

Alert time determiner 1320 includes functionality to determine the time at which each of one or more RAs are to be issued or transmitted. According to an embodiment, the time is determined as substantially the latest time at which the alert can be issued so that the projected current path can be adjusted with the maneuver corresponding to the RA so that the adjusted projected path does not infiltrate the cylindrical protection area. Determination of the alert times is described in relation to FIGS. 1 and 3.

Per-motion dimension resolution alert selector 1322 includes functionality to perform a first down-selection to select one or more RAs on a per motion dimension basis. According to an embodiment, the first-down selection can be performed based on encounter geometry. A first down-selection process to select per motion dimension RAs, is described in relation to FIG. 1.

Final RA selector 1324 includes functionality to select one or more RAs as the final RAs to be transmitted to the ownship or a control entity for the ownship. According to an embodiment, a single resolution is selected based on various criteria, such as, ownship capabilities and preferences, and intruder capabilities. The selection of the one or more final RAs is described above in relation to FIG. 1.

Resolution advisory transmitter 1326 includes the functionality to transmit the one or more final RAs to one or more predetermined entities. According to an embodiment, the final RAs can be transmitted to the ownship and/or a control entity, such as an air traffic control entity, that is capable of initiating the recommended maneuvers in the ownship.

CD&R system 1300 and its modules 1302-1326 may be implemented using a programming language, such as, for example, C, assembly, or Java. One or more of the modules 1302-1326 may also be implemented using hardware components, such as, for example, a field programmable gate array (FPGA) or a digital signal processor (DSP). Modules 1302-1326 may be co-located on a single platform, or on multiple interconnected platforms. According to an embodiment, CD&R system 1300 is implemented in a flight-deck computer, an air traffic control computer, or both.

According to another embodiment of the present invention, the system and components of embodiments of the present invention described herein are implemented using well known computers, such as computer 1400 shown in FIG. 14. For example, CD&R system 1000 can be implemented using computer(s) 1400.

The computer 1400 includes one or more processors (also called central processing units, or CPUs), such as a processor 1406. The processor 1406 is connected to a communication bus 1404.

The computer 1402 also includes a main or primary memory 1408, such as random access memory (RAM). The primary memory 1408 has stored therein control logic 1428A (computer software), and data.

The computer 1402 may also include one or more secondary storage devices 1410. The secondary storage devices 1410 include, for example, a hard disk drive 1412 and/or a removable storage device or drive 1414, as well as other types of storage devices, such as memory cards and memory sticks. The removable storage drive 1414 represents a floppy disk drive, a magnetic tape drive, a compact disk drive, an optical storage device, tape backup, etc.

The removable storage drive 1414 interacts with a removable storage unit 1416. The removable storage unit 1416 includes a computer useable or readable storage medium 824 having stored therein computer software 1428B (control logic) and/or data. Removable storage unit 1416 represents a floppy disk, magnetic tape, compact disk, DVD, optical storage disk, or any other computer data storage device. The removable storage drive 1414 reads from and/or writes to the removable storage unit 1416 in a well known manner.

The computer 1402 may also include input/output/display devices 1422, such as monitors, keyboards, pointing devices, etc.

The computer 1402 further includes at least one communication or network interface 1418. The communication or network interface 1418 enables the computer 1402 to communicate with remote devices. For example, the communication or network interface 1418 allows the computer 1402 to communicate over communication networks or mediums 1424B (representing a form of a computer useable or readable medium), such as LANs, WANs, the Internet, etc. The communication or network interface 1418 may interface with remote sites or networks via wired or wireless connections. The communication or network interface 1418 may also enable the computer 1402 to communicate with other devices on the same platform, using wired or wireless mechanisms.

Control logic 1428C may be transmitted to and from the computer 1402 via the communication medium 1424B.

Any apparatus or manufacture comprising a computer useable or readable medium having control logic (software) stored therein is referred to herein as a computer program product or program storage device. This includes, but is not limited to, the computer 1402, the main memory 1408, secondary storage devices 1410, and the removable storage unit 1416. Such computer program products, having control logic stored therein that, when executed by one or more data processing devices, cause such data processing devices to operate as described herein, represent embodiments of the invention.

The invention can work with software, hardware, and/or operating system implementations other than those described herein. Any software, hardware, and operating system implementations suitable for performing the functions described herein can be used.

CONCLUSION

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A method for detecting a potential airborne conflict between an ownship and an intruder, comprising:

determining a relative motion trajectory of the ownship and the intruder;

generating a plurality of resolution advisories, based upon the determined relative motion trajectory, for each of two or more motion dimensions of the ownship, wherein the motion dimensions comprise a horizontal direction, a speed. and a vertical direction of the ownship, and wherein the plurality of resolution advisories comprise at least two resolution advisories for each of the two or more motion dimensions;

determining an alert time for each of the plurality of resolution advisories;

dynamically adjusting a size of a protection zone to reduce unnecessary resolution advisories;

selecting, for each of the two or more motion dimensions, one of the resolution advisories based on a latest alert time among the determined alert times; and transmitting at least one of the selected resolution advisories to at least one of the ownship or an aircraft control entity, wherein at least the selecting is performed by one or more hardware processors.

2. The method of claim 1, wherein the generating the plurality of resolution advisories is based further upon capabilities or preferences of the ownship.

3. The method of claim 1, wherein the generating the plurality of resolution advisories is based further upon a type of the intruder.

4. The method of claim 1, further comprising:

selecting a resolution advisory for each of the motion dimensions based upon an encounter geometry of the ownship and the intruder; and selecting a final resolution advisory based at least upon one or more ownship preferences.

5. The method of claim 4, wherein the selecting the final resolution advisory is based further upon operational considerations.

6. The method of claim 5, wherein the operational considerations include a phase of flight information.

7. The method of claim 5, wherein the operational considerations include known intent of the intruder.

8. The method of claim 4, wherein the ownship preferences include at least one of a preference for vertical maneuvers or a preference for horizontal maneuvers.

9. The method of claim 4, wherein the ownship preferences are preconfigured.

10. The method of claim 4, wherein the resolution advisory for each of the motion dimensions is based further upon ownship capabilities.

11. The method of claim 4, further comprising:

detecting one or more maneuvers of at least one of the ownship or the intruder;

adjusting the size of the protection zone based upon the detected one or more maneuvers converging; and triggering at least one of the plurality of resolution advisories based upon the adjusted protection zone.

12. The method of claim 11, wherein the adjusting the size of the protection zone is based further upon a quality of measurements.

13. The method of claim 1, wherein the determining the relative motion trajectory comprises:

determining a relative velocity vector between the ownship and the intruder; and predicting a collision based upon the relative velocity vector and a protection zone.

14. The method of claim 13, wherein the protection zone has a shape of a cylinder of a finite height.

15. The method of claim 14, wherein the cylinder is bounded by two planar end-caps.

16. The method of claim 13, further comprising:

determining a current position of the ownship; and defining a North-East-Down (NED) Cartesian coordinate frame centered on the current position of the ownship.

17. The method of claim 16, further comprising:

determining a relative position of the intruder; and defining the protection zone centered on the relative position of the intruder in the NED Cartesian coordinate frame.

18. A system for detecting a potential airborne conflict between an ownship and an intruder, comprising:

at least one processor;

a relative velocity determiner configured to determine a relative velocity of the ownship and the intruder;

a resolution advisory generator configured to generate a plurality of resolution advisories, based upon the determined relative velocity, for each of two or more motion dimensions of the ownship, wherein the motion dimensions comprise a horizontal direction, a speed, and a vertical direction of the ownship, and wherein the plurality of resolution advisories comprise at least two resolution advisories for each of the two or more motion dimensions;

an alert generator configured to determine an alert time for each of the plurality of resolution advisories;

a conflict detector configured to dynamically adjust a size of a protection zone to reduce unnecessary resolution advisories based upon a detected maneuver converging; and a resolution advisory selector configured to select, for each of the two or more motion dimensions, one of the resolution advisories based on a latest alert time among the determined alert times.

19. The system of claim 18 further comprising:

a per-dimension resolution advisory selector configured to select a resolution advisory for each of the motion dimensions based upon an encounter geometry of the ownship and the intruder; and a final resolution advisory selector configured to select a final resolution advisory based at least upon one or more ownship preferences.

20. A non-transitory computer readable media storing instructions wherein said instructions when executed are adapted to detect a potential airborne conflict between an ownship and an intruder with a method comprising:

determining a relative velocity of the ownship and the intruder;

generating a plurality of resolution advisories, based upon the determined relative velocity, for each of two or more motion dimensions of the ownship, wherein the motion dimensions comprise a horizontal direction, a speed, and a vertical direction of the ownship, and wherein the plurality of resolution advisories comprise at least two resolution advisories for each of the two or more motion dimensions;

determining an alert time for each of the plurality of resolution advisories;

dynamically adjusting a size of a protection zone to reduce unnecessary resolution advisories based upon a detected maneuver converging;

selecting, for each of the two or more motion dimensions, one of the resolution advisories based on a latest alert time among the determined alert times; and transmitting at least one of the selected resolution advisories to at least one of the ownship or an aircraft control entity.

* * * * *

UNITED STATES PATENT AND TRADEMARK OFFICE

CERTIFICATE OF CORRECTION

PATENT NO. : 8,892,348 B2
APPLICATION NO. : 12/949070
DATED : November 18, 2014
INVENTOR(S) : Roxaneh Chamlou It is certified that error appears in the above-identified patent and that said Letters Patent is hereby corrected as shown below:

In The Claims

In column 23, line 34, please replace “speed.” with --speed,--.

Signed and Sealed this
Twenty-first Day of April, 2015

Michelle K. Lee

Michelle K. Lee
*Director of the United States Patent and Trademark Office*